US008080277B2

(12) United States Patent
Takashima et al.

(10) Patent No.: US 8,080,277 B2
(45) Date of Patent: Dec. 20, 2011

(54) METHOD OF FORMING ORGANIC COMPOUND LAYER, METHOD OF MANUFACTURING ORGANIC EL ELEMENT AND ORGANIC EL ELEMENT

(75) Inventors: Nobuhiko Takashima, Hino (JP); Seiichi Tobisawa, Hachioji (JP); Masaaki Murayama, Hachioji (JP); Yousuke Takashima, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 1074 days.

(21) Appl. No.: 11/886,290

(22) PCT Filed: Feb. 23, 2006

(86) PCT No.: PCT/JP2006/303225

§ 371 (c)(1), (2), (4) Date: Sep. 13, 2007

(87) PCT Pub. No.: WO2006/100868

PCT Pub. Date: Sep. 28, 2006

(65) Prior Publication Data

US 2008/0213621 A1 Sep. 4, 2008

(30) Foreign Application Priority Data

Mar. 18, 2005 (JP) ..... 2005-079146

(51) Int. Cl.

| | |
|---|---|
| ***B05D 5/06*** | (2006.01) |
| ***B05D 3/12*** | (2006.01) |
| ***B05D 3/02*** | (2006.01) |
| ***B41F 5/16*** | (2006.01) |

(52) U.S. Cl. ..... 427/66; 427/177; 427/384; 101/178; 101/181

(58) Field of Classification Search ..... 427/66, 427/384, 177; 101/178, 181

See application file for complete search history.

(56) References Cited

U.S. PATENT DOCUMENTS

| | | | | |
|---|---|---|---|---|
| 6,593,690 | B1 | 7/2003 | McCormick et al. | |
| 6,867,539 | B1 * | 3/2005 | McCormick et al. | 313/504 |
| 2001/0020085 | A1 * | 9/2001 | Ueda et al. | 528/425 |
| 2002/0003397 | A1 * | 1/2002 | Yamazaki | 313/483 |
| 2002/0186287 | A1 * | 12/2002 | Kawase | 347/100 |
| 2003/0082984 | A1 * | 5/2003 | Hayashi et al. | 445/24 |
| 2005/0042430 | A1 * | 2/2005 | Toyoda | 428/209 |

(Continued)

FOREIGN PATENT DOCUMENTS

| | | |
|---|---|---|
| EP | 0 986 112 A2 | 3/2000 |

(Continued)

*Primary Examiner* — James Lin

(74) *Attorney, Agent, or Firm* — Holtz, Holtz, Goodman & Chick, PC

(57) ABSTRACT

A method of forming an organic compound layer for producing organic EL element exhibiting high quality and high productivity without increasing cost; a relevant process for producing an organic EL element. There is provided a method of forming an organic compound layer of organic EL element using production apparatus including supply section, coating•drying section and recovery section, characterized in that flexible band substrate (A) having an anode layer in roll form is fed to the supply section; the production apparatus has at least one unit coating•drying section, the unit containing coating section capable of forming coating film for formation of organic compound later under atmospheric pressure by wet applicator and drying section; and at least one organic compound layer is formed on the anode layer to obtain flexible band substrate (B), which is wound on a core to form a roll in the recovery section.

12 Claims, 7 Drawing Sheets

U.S. PATENT DOCUMENTS

| | | | | |
|---|---|---|---|---|
| 2005/0101064 | A1* | 5/2005 | Yamazaki et al. | 438/149 |
| 2005/0164425 | A1* | 7/2005 | Tuomikoski et al. | 438/99 |

FOREIGN PATENT DOCUMENTS

| | | | |
|---|---|---|---|
| JP | 09-102393 | A | 4/1997 |
| JP | 10-077467 | A | 3/1998 |
| JP | 2001-006875 | | 1/2001 |
| JP | 2002-170667 | A | 6/2002 |
| JP | 2003-077669 | A | 3/2003 |
| JP | 2003-509817 | A | 3/2003 |
| JP | 2003-142260 | A | 5/2003 |
| JP | 2004-185951 | A | 7/2004 |
| JP | 2004-247100 | A | 9/2004 |
| JP | 2004-305912 | A | 11/2004 |
| JP | 2004-311111 | A | 11/2004 |
| JP | 2004-534676 | A | 11/2004 |
| JP | 2005-327667 | A | 11/2005 |
| WO | WO 01/05194 | A1 | 1/2001 |
| WO | WO 03/0062242 | A1 | 1/2003 |

* cited by examiner

FIG. 1 ( a )
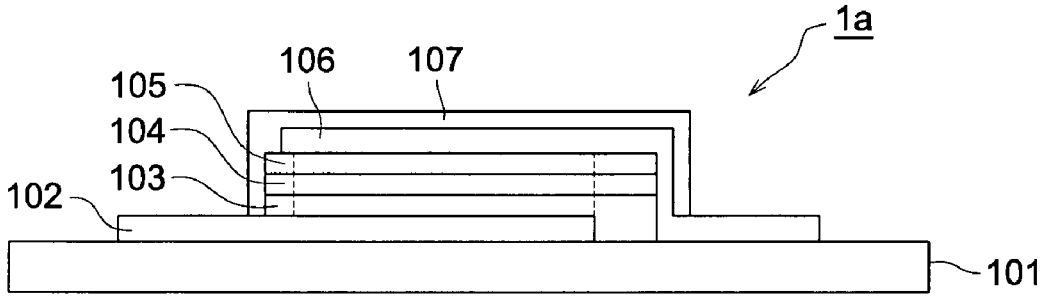
FIG. 1 ( b )
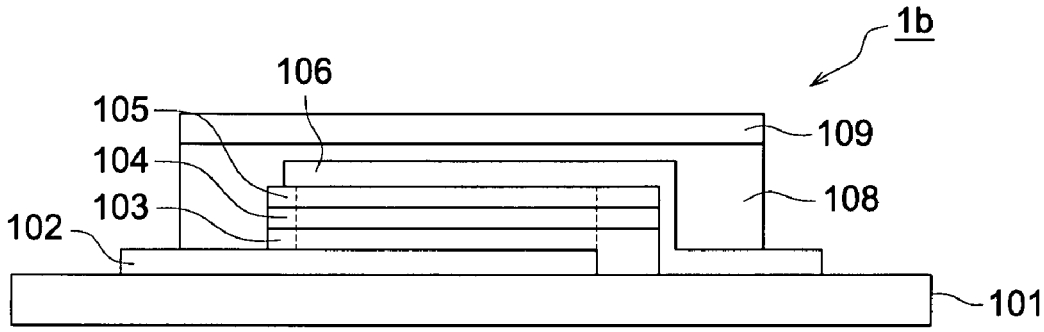

METHOD OF FORMING ORGANIC COMPOUND LAYER, METHOD OF MANUFACTURING ORGANIC EL ELEMENT AND ORGANIC EL ELEMENT

This application is the United States national phase application of International Application PCT/JP2006/303225 filed Feb. 23, 2006.

FIELD OF THE INVENTION

The present invention relates to a method of forming an organic compound layer of an organic EL element which is applied for such as a plane light source and a display panel, a manufacturing method of an organic EL element and an organic EL element manufactured by said method.

BACKGROUND

In recent years, an organic EL element utilizing an organic substance has a bright prospect of application as a low priced full color display element having a large area and a light source alley for writing, as a solid emission type, and active research and development thereof is on the way. An organic EL element is a thin film type element which is provided with the first electrode (a cathode or an anode), an organic compound layer (comprising a single layer or plural layers) containing an organic emission substance being accumulated thereon, that is a light emission layer, and the second electrode (a cathode or an anode) accumulated on said light emission layer. When voltage is applied on such an organic EL element, an electron is injected into an organic compound layer from the cathode and a hole is injected from the anode. It is known that said electron and hole are recombined in an emission layer and light emission is obtained by releasing energy as light at the time of an energy level returns to a valence electron band from a conduction band.

As described above, since an organic EL element is a thin film type element, an apparatus equipped with a panel light source can be easily made to be a thin layer type when an organic EL panel, comprising one or plural number of organic EL elements formed on a substrate, is utilized as a plane light source of such as a backlight. Further, when a display device is constituted utilizing an organic EL element panel, in which a predetermined number of organic EL elements as pixels are formed on a substrate, as a display panel, there are advantages such as high visual recognition and no viewing angle dependence, which are not available with a liquid crystal display.

On the other hand, at the time of forming an organic compound layer of an organic EL element, various methods such as an evaporation method, a sputtering method, a CVD, a PVD, a coating method utilizing a solvent, as described in JP-A Nos. 9-102393 and 2002-170676 (hereinafter, JP-A refers to Japanese Patent Publication Open to Public Inspection No.); however, among these, it is known that a wet film forming method such as a coating method is advantageous in view of such as simplification of a manufacturing process, reduction of a manufacturing cost, improvement of a processing property and an application to a flexible element having a large area such as a backlight and an illumination light source. For example, a method to form an organic compound layer on a glass plate of a sheet form by a spin coat method is described in JP-A 2002-170676. A method to successively form organic compound layers on a glass plate of a sheet form by an inkjet method is described in JP-A 2003-142260. In any of these methods, an apparatus becomes large as well as a cost becomes high to manufacture a full color display element having a large area because a sheet form substrate is utilized as a substrate. Therefore, studies are made on a method to manufacture an organic EL element, which has a bright prospect of application as a low priced full color display element having a large area and a light source alley for writing, as a solid emission type. For example, known is a method in which patterning of one or a plural number of emission layers comprising an organic substance and patterning of a cathode are performed by means of a roll to roll method and an evaporation under vacuum method as a method to manufacture an organic EL display in which plastic film is utilized as a transparent substrate and one or a plural number of emission layers comprising an organic substance and an anode layer are provided on this plastic film (for example, refer to patent literature 1).

Since a roll to roll method described in patent literature 1 enable mass production different from a conventional sheet method, manufacturing of an organic EL element is possible at a low cost, however, there are following disadvantages.

1) The using efficiency of an organic substance, which is utilized to form one or a plural number of emission layers comprising an organic substance is low, which is one reason to increase the cost.

2) Since it is a method to form one or a plural number of emission layers comprising an organic substance by an evaporation method, it is difficult to scale up because an evaporation room has to be made large accordingly to require associated equipment having a high capacity, to prepare a display element having a large area.

3) Since it is a method to form one or a plural number of emission layers comprising an organic substance by an evaporation method, it takes long time to form an emission layer resulting in difficulty to increase productivity.

4) Particularly in the case of an organic EL element utilized for an illumination application, it is difficult to form an organic EL element having a large area without unevenness because an organic EL element having a large area has to be formed in an evaporation method.

In view of these situations, desired has been development of a forming method of an organic compound layer for an organic EL element application having high productivity without increasing a cost and having a large area without unevenness, a manufacturing method of an organic EL element utilizing said organic compound layer and an organic EL element.

[Patent Literature 1] PCT International Application Publication No. 01/5194 Pamphlet

DISCLOSURE OF THE INVENTION

Problems to be Solved

The present invention has been made in view of the above-described situation, and an object thereof is to provide a highly productive method of forming an organic compound layer for a high quality organic EL element without increasing the production cost, a method of manufacturing an organic EL element utilizing said organic compound layer and an organic EL element.

Means to Solve the Problems

The above object of the present invention is achieved by the following structures.

(Embodiment 1)

A method of forming an organic compound layer of an organic EL element, the organic EL element comprising a flexible band substrate having thereon an anode layer comprising a first electrode, the organic compound layer, a cathode layer comprising a second electrode and a sealing layer or a sealing film, in that order, using a manufacturing apparatus comprising a supplying section, a coating•drying section in which the organic compound layer is formed on the anode layer, and a recovery section, coating•drying wherein flexible band substrate A is supplied to the supplying section as a roll wound on a core, flexible band substrate A comprising the anode layer comprising at least the first electrode;

the coating•drying section comprises a coating section and a drying section to form one unit, wherein, in the coating section, the organic compound layer is formed using a wet coating device for applying an organic compound layer coating liquid under an atmospheric pressure, and, in the drying section, an organic solvent in the organic compound layer is removed under an atmospheric pressure to form the organic compound layer;

the manufacturing apparatus comprises at least one unit of the coating•drying section;

at least one organic compound layer is formed on the anode layer in the coating•drying section to form flexible band substrate B; and flexible band substrate B is wound on a core to form a roll in the recovery section.

(Embodiment 2)

The method of embodiment 1, wherein flexible band substrate A is subjected to a cleaning-surface modifying treatment before the organic compound layer coating liquid is applied.

(Embodiment 3)

The method of embodiment 2, wherein a means of the cleaning-surface modifying treatment is oxygen plasma or UV irradiation.

(Embodiment 4)

The method of any one of embodiments 1 to 3, wherein flexible band substrate A is subjected to a static elimination treatment using a static eliminating means.

(Embodiment 5)

The method of any one of embodiments 1 to 4, wherein a variation of a conveying speed of flexible band substrate A while the organic compound layer coating liquid is applied is 0.2 to 10% based on an average conveying speed.

(Embodiment 6)

The method of any one of embodiments 1 to 5, wherein the organic compound layer is formed by removing the organic solvent in the organic compound layer by an air drying method in which an air ejection velocity is 0.1 to 5 m/s while a variation of the air ejection velocity in the width direction is 0.1 to 10%, in the drying section.

(Embodiment 7)

The method of any one of embodiments 1 to 6, wherein the organic compound layer coating liquid comprises at least one organic compound material and at least one solvent, and exhibits a surface tension of $15\times10^{-3}$ to $55\times10^{-3}$ N/m.

(Embodiment 8)

The method of any one of embodiments 1 to 7, wherein the manufacturing apparatus comprises a heat treating section which follows the drying section.

(Embodiment 9)

The method of embodiment 8, wherein, just after the organic compound layer is formed in the drying section, the organic compound layer is subjected to a heat treatment using a back-surface heat transmission at a heat treatment temperature of −30 to +30° C. based on a glass transition temperature of the organic compound layer, while the heat treatment temperature does not exceed a decomposition temperature of the organic compound layer.

(Embodiment 10)

The method of any one of embodiments 1 to 9, wherein the organic compound layer is formed in an atmosphere having a dew point of −20° C. or lower, a cleanliness class according to JIS B 9920 of class 5 or less, a temperature of 10 to 45° C. excluding the drying section and a heat treatment section, under an atmospheric pressure.

(Embodiment 11)

The method of any one of embodiments 1 to 10, wherein the organic compound layer comprises at least a hole transport layer and an organic light emission layer.

(Embodiment 12)

The method of any one of embodiments 1 to 11, wherein flexible band substrate B is stored under a reduced pressure of $10^{-5}$ to 10 Pa.

(Embodiment 13)

A method of manufacturing an organic EL element comprising a flexible band substrate having thereon an anode layer comprising a first electrode, an organic compound layer, a cathode layer comprising a second electrode and a sealing layer, in that order, using a manufacturing apparatus comprising a supplying section, a coating•drying section in which the organic compound layer is formed on the anode layer, a cathode layer forming section in which the cathode layer comprising the second electrode is formed on the organic compound layer, a sealing layer forming section in which a sealing layer I formed on the cathode layer and a recovery section, wherein flexible band substrate A is supplied to the supplying section as a roll wound on a core, flexible band substrate A comprising the anode layer comprising at least the first electrode;

the coating•drying section comprises a coating section and a drying section to form one unit, wherein, in the coating section, the organic compound layer is formed using a wet coating device for applying an organic compound layer coating liquid under an atmospheric pressure, and, in the drying section, an organic solvent in the organic compound layer is removed under an atmospheric pressure to form the organic compound layer;

the manufacturing apparatus comprises at least one unit of the coating•drying section;

at least one organic compound layer is formed on the anode layer in the coating•drying section to form flexible band substrate B; and flexible band substrate B is wound on a core in a first winding section to form a roll;

the cathode layer including the second electrode is formed on the organic compound layer under a reduced pressure, in the coating•drying section, using the roll of flexible band substrate B;

subsequently, the sealing layer is formed on the cathode layer under a reduced pressure in the sealing layer forming section to form the organic EL element; and the organic EL element is wound on a core to form a roll in the recovery section.

(Embodiment 14)

A method of manufacturing an organic EL element comprising a flexible band substrate having thereon an anode layer comprising a first electrode, an organic compound layer, a cathode layer comprising a second electrode and a sealing film, in that order, using a manufacturing apparatus comprising a supplying section, a coating•drying section in which the organic compound layer is formed on the anode layer, a cathode layer forming section in which the cathode layer including the second electrode is formed on the organic compound layer, a sealing film adhering section in which a sealing film is adhered on the cathode layer, and a recovery section, wherein flexible band substrate A is supplied to the supplying section as a roll wound on a core, flexible band substrate A comprising the anode layer comprising at least the first electrode;

the coating•drying section comprises a coating section and a drying section to form one unit, wherein, in the coating section, the organic compound layer is formed using a wet coating device for applying an organic compound layer coating liquid under an atmospheric pressure, and, in the drying section, an organic solvent in the organic compound layer is removed under an atmospheric pressure to form the organic compound layer;

the manufacturing apparatus comprises at least one unit of the coating•drying section;

at least one organic compound layer is formed on the anode layer in the coating•drying section to form flexible band substrate B;

flexible band substrate B is wound on a core in a first winding section to form a roll;

the cathode layer comprising the second electrode is formed on the organic compound layer under a reduced pressure, in the cathode layer forming section, using the roll of flexible band substrate B to form flexible band substrate C;

flexible band substrate C is wound on a core in a second winding section to form a roll; and the sealing film is adhered on the cathode layer using the roll of flexible band substrate C in an inert gas atmosphere in the sealing film adhering section to form the organic EL element.

(Embodiment 15)

An organic EL element manufactured by the method of embodiment 13 or 14.

EFFECTS OF THE INVENTION

The present invention provides a highly productive method to form an organic compound layer for an organic EL element application having a high quality without increase of a cost, manufacturing method of an organic EL element utilizing said organic compound layer and an organic EL element, and enables to manufacture an organic EL element having a large area which can be primarily utilized as a plane light source for such as an illumination and a backlight.

BRIEF DESCRIPTION OF THE DRAWINGS

FIGS. 1(*a*) and 1(*b*) are schematic cross sectional views to show examples of layer constitutions of organic EL elements.

DESCRIPTION OF THE SYMBOLS

Figure 2:
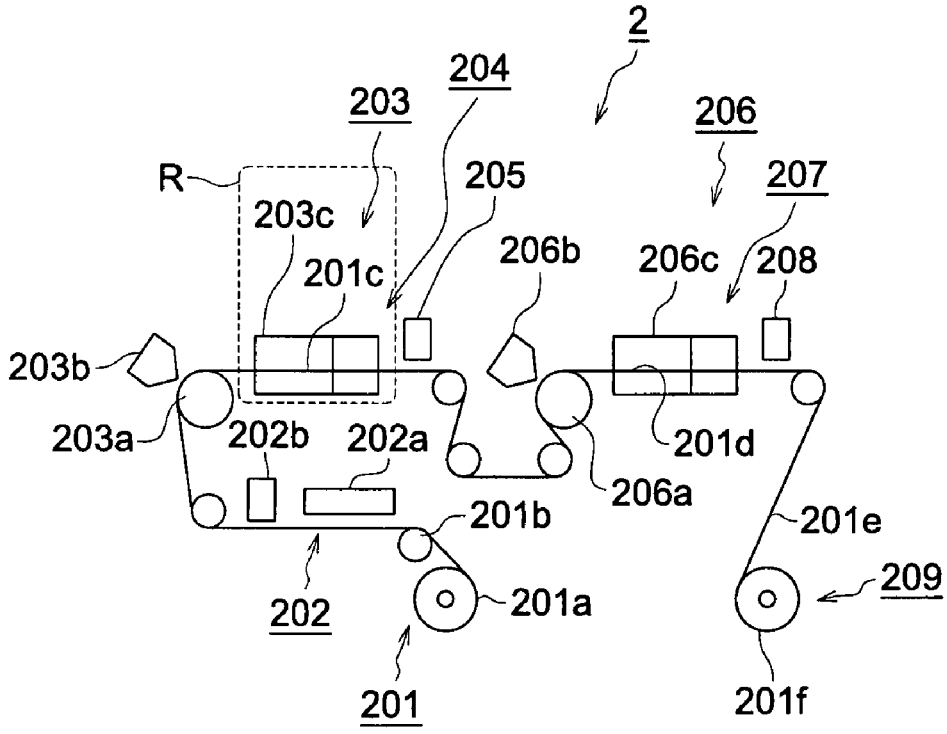
FIGS. 2(*a*) and 2(*b*) are schematic drawings of a process to form until an organic compound layer which is a constituent layer of an organic EL element.
Figure 2:
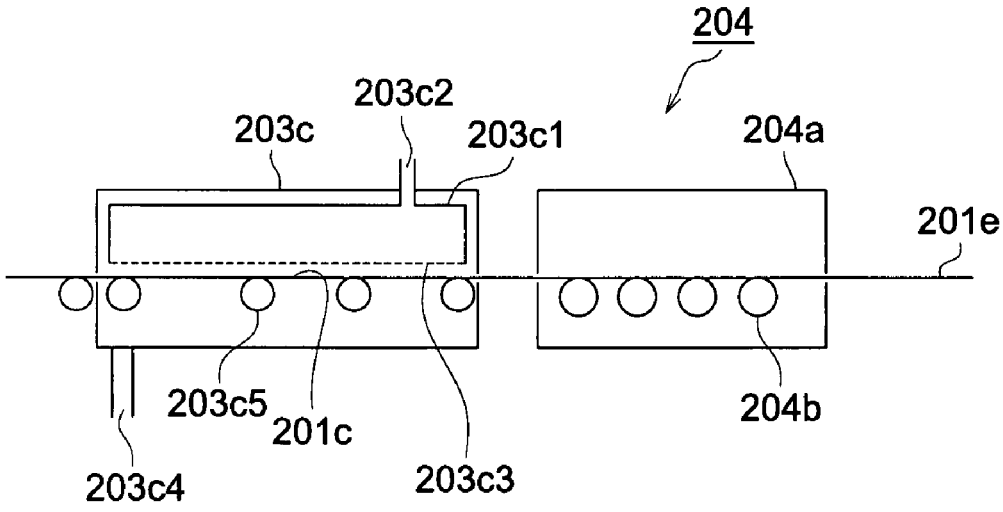

| | |
|---|---|
| 1a, 1b: | organic EL element |
| 101: | substrate |
| 102: | anode layer |
| 103, 201c: | hole transport layer |
| 104, 201e: | organic compound layer (emission layer) |
| 105, 201i: | electron injection layer (electron transfer layer) |
| 106, 201j: | cathode layer |
| 107: | sealing layer |
| 108: | adhesive layer |
| 109: | sealing film |
| 2, 3, 7: | manufacturing apparatus |
| 201, 401, 501, 801: | supply section |
| 201b: | flexible band substrate A |
| 201h, 201f: | flexible band substrate B |
| 201k, 201l: | flexible band substrate C |
| 201m: | sealing film |
| 201o: | first electrode |
| 202: | cleaning surface modification treatment section |
| 203: | first coating•drying section |
| 203b: | first wet coater |
| 203c: | first dryer |
| 204: | first heat treatment section |
| 206: | secod coating•drying section |
| 206b: | second wet coater |
| 207: | second heat treatment section |
| 209, 6, 404, 503, 9: | recovery section |
| 4: | cathode layer forming section |
| 402, 802: | first cathode layer forming section |
| 403, 803: | second cathode layer forming section |
| 404: | second winding section |
| 5: | sealing film pasting section |
| 502: | pasting section |
| 8: | cathode layer•sealing layer forming section |
| 804: | sealing layer forming section |
| 601, 901: | organic EL element |

PREFERRED EMBODIMENT OF THE INVENTION

Embodiments to practice the present invention will be explained referring to FIGS. 1-7, however the present invention is not limited thereto.

FIG. 1 is a brief cross sectional view to show an example of a layer constitution of an organic EL element. FIG. 1(*a*) is a brief cross sectional view to show a layer constitution of an organic EL element provided with a sealing layer. FIG. 1(*b*) is a brief cross sectional view to show a layer constitution of an organic EL element which has been formed by pasting up sealing film sandwiching an adhesive layer.

A layer constitution of an organic EL element shown in FIG. 1(*a*) will be explained. In the drawing, 1*a* is an organic EL element. Organic EL element 1*a* is provided with anode layer 102, hole transfer layer 103, organic compound layer (light emission layer) 104, electron injection layer 105, cathode layer 106 and sealing layer 107 in this order on substrate 101.

A layer constitution of an organic EL element shown in FIG. 1(*b*) will now be explained.

In the drawing, 1*b* is an organic EL element. Organic EL element 1*b* is provided with anode layer 102, hole transport layer 103, organic compound layer (emission layer) 104, electron injection layer 105, cathode layer 106, adhesive layer 108 and sealing film 109 in this order on substrate 101. In an organic EL element shown in this drawing, a hole injection layer (not shown in the drawing) may be provided between anode layer 102 and hole transfer layer 103. Further, an electron transfer layer (not shown in the drawing) may be provided between cathode 106 and organic compound layer (emission layer) 104 and electron injection layer 105. In organic EL element 1*a* and organic EL element 1*b*, a gas barrier layer (not shown in the drawing) may be provided between anode 102 and substrate 101.

The present invention relates to a method to form organic compound layer (emission layer) 104 and organic compound layer (hole transport layer) 103; a manufacturing method of organic EL element 1*a*, in which electron injection layer 105, cathode 106 and sealing layer 107 are formed on formed organic compound layer (emission layer) 104 and organic compound layer (hole transport layer) 103, and a manufacturing method of organic EL element 1*b*, in which electron injection layer 105, cathode 106 and sealing film 109 are pasted up are pasted up on formed organic compound layer (emission layer) 104 sandwiching adhesive layer 108; and organic EL element prepared by these manufacturing methods.

The layer constitution of an organic EL element shown in this drawing is an example, and other typical layer constitutions of an organic EL element include the following constitutions.

(1) substrate/anode/emission layer/electron transport layer/cathode/sealing layer (2) substrate/anode/hole transport layer/emission layer/hole block layer/electron transport layer/cathode/sealing layer (3) substrate/anode/hole transport layer (hole injection layer)/emission layer/hole block layer/electron transport layer/cathode buffer layer (electron injection layer)/cathode/sealing layer A sealing layer utilized in above-described (1)-(4) includes a sealing layer alone, sealing film with intervening adhesive layer, or a combination thereof.

Each layer constituting an organic EL element will be explained later.

FIG. 2 is a schematic drawing of a process to form until an organic compound layer. FIG. 2(*a*) is a schematic drawing of a process to form until an organic compound layer which is a constituent layer of an organic EL element. FIG. 2(*b*) is an enlarged schematic drawing of a portion represented by R of FIG. 2(*a*). Herein, this drawing shows the case of a manufacturing apparatus provided with two units of coating•drying sections.

In the drawing, 2 is a manufacturing apparatus to form until an organic compound layer which is one of a constitution layer of an organic EL element under an atmospheric pressure condition. Manufacturing apparatus 2 is provided with supply section 201 of a flexible band substrate, washing surface modification treatment section 202 of a flexible band substrate, first coating•drying section 203, first heat treatment section 204, second static elimination treatment section, second coating•drying section 206, second heat treatment section 207, third static elimination treatment section 208 and recovery section 209.

In supply section 201, flexible band substrate A 201*a*, on which a gas barrier layer and an anode layer including the first electrode have been formed in this order already, being wound on a core to make a roll is supplied.

Washing surface modification treatment section 202 is provided with washing modification surface treatment means 202*a* to modify the anode layer surface (not shown in the drawing) of flexible band substrate A201*b*, which is sent from supply section, and first static elimination treatment means 202*b*, before coating an organic compound layer coating solution. Washing surface modification treatment means 202*a* includes such as a low pressure mercury lamp, an excimer lamp and a plasma washing apparatus. A condition of washing surface modification treatment by a low pressure mercury lamp includes, for example, a condition to perform washing surface modification treatment by irradiation with a low pressure mercury lamp having a wavelength of 184.2 nm, at irradiation strength of 5-20 mW/cm$^2$ and a distance of 5-15 mm. As a condition of washing surface modification treatment by a plasma washing apparatus, an atmospheric plasma is suitably applied and the washing condition includes, for example, a condition to perform washing surface modification treatment by use of an argon gas containing 1-5 volume % of oxygen at a frequency of 100 kHz-150 MHz, a voltage of 10 V-10 kV and an irradiation distance of 5-20 mm.

First static elimination treatment means 202*b* includes such as a light irradiation method and a corona discharge method, and may be appropriately selected among them. A light irradiation method generates an air ion by very weak X rays and a corona discharge method generates an air ion by corona discharge. This air ion compensates charges of an opposite polarity to neutralize static electricity. A static elimination by corona discharge and a static elimination by soft X rays can be utilized. Since static elimination of a substrate is promoted by the first static elimination means to prevent adhesion of dust and dielectric breakdown, yield of the element is increased.

First coating•drying section 203 is provided with backup roll 203*a* to hold flexible band substrate A201*b*, first wet coater 203*b* to coat the first organic compound layer coating solution on flexible band substrate A201*b* held by backup roll 203*a*, and first dryer 203*c* to remove a solvent of first organic compound layer 201*c* formed on the anode layer (not shown in the drawing) on flexible band substrate A201*b*.

204 is the first heat treatment section and the first heat treatment section is provided with apparatus main body 204*a* and a plural number of heating rollers 204*b* to heat first organic compound layer 201*c* from the back-surface of a flexible band substrate, on which first organic compound layer 201*c* has been formed, by a back-surface heat transmission method.

First dryer 203*c* is provided with drying air supply header 203*c*1, which has ejection outlet 203*c*3 to eject drying air and supply gate 203*c*2 of drying air, exhaust gate 203*c*4 and transport rolls 203*c*5.

205 is the second static elimination treatment means to perform static elimination of formed first organic compound layer 201*c*. Herein, in this drawing, the first organic compound layer coating solution is a hole transport layer coating solution, and the first organic compound layer 201*c* is a hole transport layer.

Second coating•drying section 206 is provided with second wet coater 206*b* to coat the second organic compound layer coating solution on a flexible band substrate, which is held by backup roll 206*c* and provided with first organic compound layer (hole transport layer) 201*c*, and second dryer 206*c* to dry second organic compound layer 201*d* having been formed on first organic compound layer (hole transport layer) 201*c*. Herein, in this drawing, the second organic compound layer coating solution is an emission layer coating solution, and the second organic compound layer 201*d* is an emission layer.

207 is the second heat treatment section and heat treatment section 207 has the same constitution as first heat treatment section 204 to heat second organic compound layer 201*d*, which has been formed on first organic compound layer (hole transport layer) 201*c*, by a back-surface heat transmission method from the back-surface of a flexible band substrate.

208 is the third static elimination means to perform static elimination of formed second organic compound layer (emission layer) 201*e*. Second dryer 206*c* has the same constitution as first dryer 203*c*. First static elimination means 202*b*, second static elimination means 205 and third static elimination means 208 may be same.

In this drawing, the case that a coating•drying section is provided with two units of first coating•drying section and second coating•drying section is shown, however, the number of the units can be increased when necessary.

A hole transport layer formed by being coated by use of first wet coater 203*b* is comprised of a hole transport material which has an ability of transporting a hole, and a hole injection layer and an electron block layer are included in a hole transport layer in a broad meaning. A single layer or plural layers of a hole transport layer can be provided. A hole transport material is those having any one of injection or transport ability of a hole, or barrier ability against an electron, and may be either an organic substance or an inorganic substance. For example, listed are triazole derivatives, oxazole derivatives, imidazole derivatives, polyarylalkane derivatives, pyrazoline derivatives and pyrazolone derivatives, phenylenediamine derivatives, arylamine derivatives, amino substituted calcon derivatives, oxazole derivatives, styrylanthrathene derivatives, fluorenone derivatives, hydrazone derivatives, stilbene derivatives, silazane derivatives, aniline type copolymer, and conductive polymer oligomer, and specifically thiophene oligomer.

As a hole transport material, those described above can be utilized, however, preferably utilized are a porphyrin compound, an aryl tertiary amine compound and a styrylamine compound and specifically preferably an aryl tertiary amine compound. Typical examples of an aryl tertiary amine compound and a styrylamine compound include such as N,N,N',N'-tetraphenyl-4,4'-diaminophenyl, N,N'-diphenyl-N,N'-bis(3-methylphenyl)-[1,1'-biphenyl]-4,4'-diamine (TPD), 2,2-bis(4-di-p-tolylaminophenyl)propane, 1,1-bis(4-di-p-tolylaminophenyl)cyclohexane, N,N,N',N'-tetra-p-tolyl-4,4'-diaminobiphenyl, 1,1-bis(4-di-p-tolylaminophenyl)-4-phenylcyclohexane, bis(4-dimethylamino-2-methylphenyl)phenylmethane, bis(4-di-p-tolylaminophenyl)phenylmethane, N,N'-diphenyl-N,N'-di(4-methoxyphenyl)-4,4'-diaminobiphenyl, N,N,N',N'-tetraphenyl-4,4'-diaminophenyl ether, 4,4'-bis(diphenylamino)quadoriphenyl, N,N,N-tri(p-tolyl)amine, 4-(di-p-tolylamino)-4'-[4-(di-p-tolylamino)styryl]stilbenezene, 4-N,N-diphenylamino-(2-diphenylvinyl)benzene, 3-methoxy-4'-N,N-diphenylaminostilben, N-phenylcarbazole, and those having two condensed aryl rings in a molecule which is described in U.S. Pat. No. 5,061,569 such as 4,4'-bis[N-(1-naphthyl)-N-phenylamino]biphenyl (NPD), and such as 4,4',4"-tris[N-(3-methylphenyl)-N-phenylamino]triphenylamine (MTDATA), in which three of triphenylamine units are connected in a starburst form which is described in JP-A 4-308688.

Further, polymer materials in which these materials are introduced to a polymer chain or these materials constitute a polymer main chain can be also utilized. Further, inorganic compounds such as p-type Si and p-type SiC can be also utilized as a hole injection material or a hole transport material.

Further, so-called p-type hole transport materials such as described in JP-A 11-251067 and a literature by J. Huang et al. (Applied Physics Letters 80 (2002), p. 139) can be also utilized. In the present invention, these materials are preferably incorporated because an emission element having higher efficiency can be prepared.

The layer thickness of a hole transport layer is not specifically limited, however, is generally approximately 5 nm-5 μm and preferably 5-200 nm. This hole transport layer may have a one-layer structure comprising one or at least two types of the above-described materials. Further, a hole transport layer which is doped with impurities and has a high p-property can be also utilized. Such an example includes those described in such as JP-A Nos. 4-297076, 2000-196140 and 2001-102175, and J. Appl. Phys., 95, 5773 (2004). To utilize such a hole transport layer having a high p-property is preferable because an organic EL element exhibiting lower power consumption can be prepared.

In the case that an emission layer formed by second wet coater 206*b* is comprised of multi layers, a plural number of coating•drying units has to be arranged corresponding to the number of layers to be accumulated. For example, by constituting an emission layer comprising multi layers, preparation of a white emitting element is possible. In the present invention, an emission layer means a blue emission layer, a green emission layer and a red emission layer. The order of accumulation of emission layers in the case of accumulating emission layers is not specifically limited, and further, a non-emission intermediate layer may be provided between each emission layer. In the present invention, at least one blue emission layer is preferably arranged at a position nearest to an anode among all emission layers. Further, when not less than four emission layers are arranged, a blue emission layer, a green emission layer and a red emission layer are preferably accumulated in this order from the nearest to an anode, such as a blue emission layer/a green emission layer/a red emission layer/a blue emission layer, a blue emission layer/a green emission layer/a red emission layer/a blue emission layer/a green emission layer, a blue emission layer/a green emission layer/a red emission layer/a blue emission layer/a green emission layer/a red emission layer, with respect to increasing luminance stability.

The total layer thickness of an emission layer is not specifically limited, however, is selected generally in a range of 2 nm-5 μm and preferably 2-200 nm, in consideration of such as homogeneousness of the film and voltage required for emission. It is furthermore preferably in a range of 10-20 nm. It is preferable that there is an effect to improve stability of emission color against drive current in addition to voltage aspect when the layer thickness is not more than 20 nm. A layer thickness of each emission layer is preferably selected in a range of 2-100 nm and more preferably in a range of 2-20 nm. The relationship among each emission layer of blue, green and red is not specifically limited; however, it is preferable that a blue emission layer (the total when plural layers are present) has the largest layer thickness among three emission layers.

An emission layer contains at least three layers having different emission spectra, the emission maximum wavelengths of which are in a range of 430-480 nm, 510-550 nm and 600-640 nm, respectively. There is no specific limitation provided that not less than three layers present. In the case of not less than 4 layers, there may be plural layers having the same emission spectrum. A layer having an emission maximum wavelength of 430-480 nm is referred to as a blue emission layer; a layer having an emission maximum wavelength of 510-550 nm is referred to as a green emission layer; and a layer having an emission maximum wavelength of 600-640 nm is referred to as a red emission layer. Further, in a range of maintaining the aforesaid maximum wavelength, a plural number of emission compounds may be mixed in each emission layer. For example, in a blue emission layer, a blue emitting compound having a maximum wavelength of 430-480 nm and a green emitting compound having a maximum wavelength of 510-550 nm may be utilized by being mixed.

A material utilized in an emission layer is not specifically limited, and includes various types of materials such as described in Up-to-date Trend of Flat Panel Display; The Present State and Up-to date Technical Trend of EL Display, edited by Toray Research Center Co., Ltd., pp. 228-332.

An organic compound layer (an emission layer), which has been formed by coating an organic compound coating solution by second wet coater 206*b* followed by being dried, is a layer to emit by recombination of an electron and a hole injected from an electrode, an electron injection layer or a hole injection layer, and the emitting portion may be either the interior of an emission layer or the interface between an emission layer and an adjacent layer.

A drying condition in the first dryer 203*c* to remove a solvent of a coated film of the first organic compound layer (a hole transport layer) includes air flow drying having an air ejection velocity from an ejection outlet of 0.1-5 m/s and a variation of air ejection velocity in the width direction of 0.1-10%, in consideration of such as drying unevenness and setting mottle of the coated surface. A drying condition to remove a solvent of the second organic compound layer (an emission layer) in the second dryer 206*c* may be same as the condition in the first dryer 203*c*.

As a heat treatment condition of the first organic compound layer (a hole transport layer) in first heat treatment section 204, it is preferable to perform heat treatment by means of a back-surface heat transmission method at a temperature of −30-+30° C. based on a glass transition temperature of the first organic compound layer (a hole transport layer) and not to exceed a decomposition temperature of an organic compound constituting the first organic compound layer (a hole transport layer), in consideration of smoothness improvement of the organic compound layer (a hole transport layer), removal of a residual solvent and hardening of the organic compound layer (a hole transport layer).

As a heat treatment condition of the second organic compound layer (an emission layer) in second heat treatment section 207, it is preferable to perform heat treatment by means of a back-surface heat transmission method at a temperature of −30-+30° C. based on a glass transition temperature of the second organic compound layer (an emission layer) and not to exceed a decomposition temperature of an organic compound constituting the second organic compound layer (an emission layer), in consideration of smoothness improvement of the second organic compound layer (an emission layer), removal of a residual solvent and hardening of the second organic compound layer (an emission layer).

A distribution of a transport rate of flexible band substrate A at the time of coating a first organic compound layer (hole transport layer) coating solution by first wet coater 203*b* and a distribution of a transport rate of flexible band substrate A at the time of coating a second organic compound layer (emission layer) coating solution by second wet coater 206*b* are preferably 0.2-10% based on a mean transport rate, in consideration of such as emission luminance unevenness which unevenness of a coated layer thickness in the longitudinal direction accompanies.

A first organic compound layer (hole transport layer) coating solution utilized in first wet coater 203*b* and a second organic compound layer (emission layer) coating solution utilized in second wet coater 206*b* contain at least one type of an organic compound material and at least one type of a solvent and have a surface tension of $15\times10^{-3}$-$55\times10^{-3}$ N/m in consideration of such as repellent spots and coating unevenness at the time of coating.

In a process to form the first organic compound layer (a hole transport layer) and the second organic compound layer (an emission layer), which are constituent layers of an organic EL element shown in this drawing, formation is preferably performed under an atmospheric pressure condition having a dewing point of not higher than −20° C., cleanliness, which is measured based on JISB 9920, of not more than class 5, and at 10-45° C. except in the first drying section and the second drying section, in consideration of such as ability maintenance of the first organic compound layer (a hole transport layer) and the second organic compound layer (an emission layer) and prevention of defects which adhesion of foreign matters accompanies. In the present invention, cleanliness of not more than class 5 indicates class 3-class 5.

In recovery section 209, flexible band substrate B201*e*, on which second organic compound layer (emission layer) 201*d* has been formed, is wound around a core to be made into a roll form, whereby flexible band substrate B201*f* of a roll form is prepared. At the time of winding up as a roll form, it is preferable to wind up the substrate sandwiching an interleaf having air permeability or a spacer tape which keeps space on the element surface.

The prepared flexible band substrate B201*f* of a roll form is preferably stored under a reduced pressure condition of $10^{-5}$-10 Pa, in consideration of such as ability maintenance of the first organic compound layer (a hole transport layer) and the second organic compound layer (an emission layer) and non-emission defects. A storing term is preferably 1-200 hours in consideration of removal of oxygen and a slight amount of moisture which may cause deterioration of the first organic compound layer (a hole transport layer) and the second organic compound layer (an emission layer). The substrate may be appropriately stored under a heated environment.

A flexible band substrate utilized for a flexible band substrate, on which an anode layer including the first electrode have been already formed, according to the present invention includes transparent resin film. Resin film includes polyester such as polyethylene terephthalate (PET) and polyethylene naphthalate (PEN); polyethylene; polypropylene; cellophane; cellulose esters such as cellulose diacetate, cellulose triacetate, cellulose acetate butyrate, cellulose acetate propionate (CAP), cellulose acetate phthalate (TAC) and cellulose nitrate or derivatives thereof; polyvinylidene chloride; polyvinyl alcohol; polyethylene vinylalcohol; syndiotactic polystyrene; polycarbonate; norbornene resin; polymethylpenetene; polyether ketone; polyimide; polyether sulfone (PES); polyphenylene sulfide; polysulfones; polyether imide, polyether ketone imide; polyamide; fluorine-contained resin; nylon; polymethyl methacrylate; acryls or polyallylates; and cycloolefin type resin such as Arton (product name, manufactured by JSR Co., Ltd.) or Apel (product name, manufactured by Mitsui Chemicals, Inc.).

As an anode, those employing a metal, an alloy, a conductive compound and a mixture thereof having a large work function (not less than 4 eV) as an electrode substance are preferably utilized. As specific examples of such an electrode substance, a metal such as Au and a conductive transparent material such as CuI, indium tin oxide (ITO), $SnO_2$ and ZnO. Further, a material capable of forming amorphous and transparent conductive film such as IDIXO ($In_2O_3$.ZnO) may be also utilized. As an anode, a pattern of a desired form may be formed by a photolithographic method after forming thin film by a method such as evaporation or sputtering, or the pattern may be formed through a mask of a desired form at the time of evaporation or sputtering of the above-described electrode substance in the case of patterning precision being not much required (approximately not less than 100 μm). Further, in the case of utilizing a substance capable of being coated such as an organic conductive compound, a wet film forming method such as a printing method and a coating method can be also utilized. When emission is taken out from this anode, the transparency is desirably made to be not less than 10%, and a sheet resistance as an anode is preferably not more than a few hundreds Ω/□. Further, a layer thickness depends on a material, however, is selected in a rage of generally 10-1,000 nm and preferably 10-200 nm.

Between an anode and an organic compound layer (an emission layer) or a hole transport layer, a hole injection layer (an anode buffer layer) may be provided. An injection layer is a layer provided between an electrode and an organic layer in order to decrease driving voltage and improve emission efficiency, and is detailed in 2nd volume 2nd chapter "Electrode Material" (pp. 123-166) of "Organic EL Element and Front of Industrialization Thereof (Published by N. T. S. Co., Ltd., Nov. 30, 1998)".

An anode buffer layer (a hole injection layer) is detailed in such as JP-A Nos. 9-45479, 9-260062 and 8-288069, and specific examples include a phthalocyanine buffer layer represented by copper phthalocyanine, an oxide buffer layer represented by vanadium oxide, an amorphous carbon buffer layer, a polymer buffer layer utilizing conductive polymer such as polyaniline (emeraldine) and polythiophene. An anode buffer layer (a hole injection layer) is preferably very thin film and the layer thickness, although depends on materials, is preferably in a range of 1 nm-5 μm.

Gas barrier film is appropriately formed on the surface of resin film utilized as a flexible band substrate. Gas barrier film includes film of an inorganic substance, an organic substance or hybrid film of the both. As the characteristic of gas barrier film, a water vapor permeability is preferably not more than 0.01 $g/m^2$·day·atm. Further, film having a high barrier capability of an oxygen permeability of not more than $10^{-3}$ $ml/m^2$/day and a water vapor permeability of not more than $10^{-5}$ $g/m^2$/day is preferable.

As a material to form barrier film, a material provided with a function to restrain invasion of such as moisture and oxygen, which may induce deterioration of an element, is preferable and such as silicon oxide, silicon dioxide and silicon nitride can be utilized. Further, to overcome brittleness of said film, it is more preferable to provide an accumulation structure comprising an inorganic layer and a layer comprising an organic material. The order of accumulation of an inorganic layer and an organic layer is not specifically limited; however, it is preferable to alternately accumulate the both in plural times. A forming method of barrier film is not specifically limited, and such as a vacuum evaporation method, a sputtering method, a reactive sputtering method, a molecular beam epitaxy method, a cluster ion beam method, an ion plating method, a plasma polymerization method, an atmospheric pressure plasma polymerization method, a plasma CVD method, a laser CVD method, a thermal CVD method and a coating method can be utilized, however, an atmospheric pressure plasma polymerization method such as described in JP-A 2004-68143 is specifically preferable.

As a wet coater utilizable as first wet coater 203*b* and second wet coater 206*b*, for example, a coater of such as a die coat method, a screen printing method, a flexography method, an inkjet method, a wire-bar method, a cap coat method, a spray coat method, a cast method, a roll coat method and a gravure coat method can be utilized. Utilization of these wet coaters can be suitably selected depending on a material of an organic compound layer.

A forming method of an organic compound layer, in which flexible band substrate A, on which an anode layer including the first electrode has been formed, is utilized to be made into flexible band substrate B by forming the first organic compound layer (a hole transport layer) and the second organic compound layer (an emission layer) on the anode layer, then the flexible band substrate B is wound on a core to be made into flexible band substrate B of a roll-form, can achieve the following effects compared to the evaporation method.

1) It becomes possible to depress a cost because using efficiency of an organic compound, which is utilized to form one or a plural number of emission layers comprising an organic compound, is high.

2) Formation of a large area organic compound layer, which is required to form a large area organic EL element, becomes easy.

3) Improvement of a rate of operation is possible because organic compound layer can be formed in a short time.

4) Formation of a large area organic compound layer, which is required to form a large area organic EL element, becomes easy.

Figure 3:
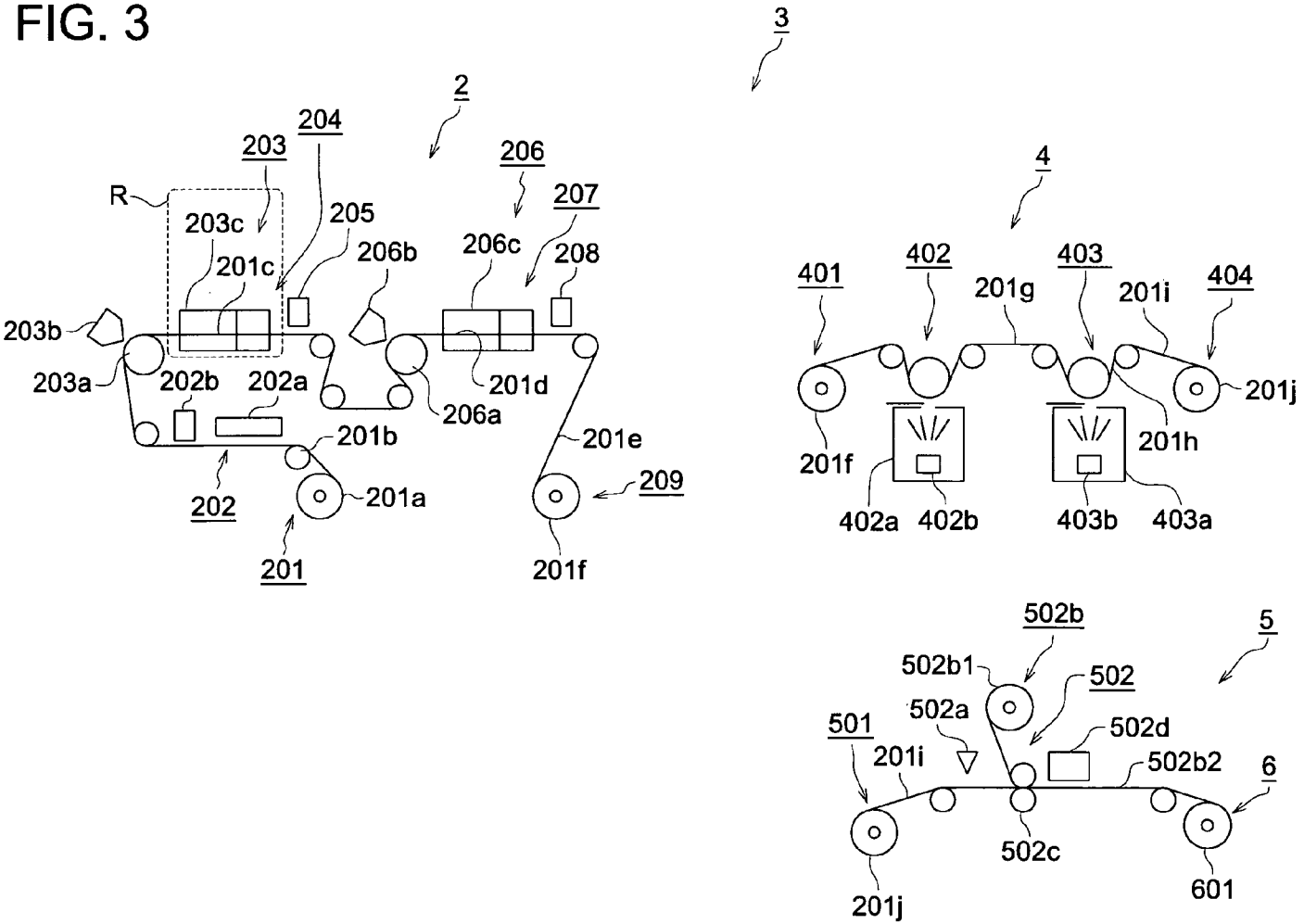
FIG. 3 is a schematic drawing to show an example of a process to prepare an organic EL element.

FIG. 3 is a schematic drawing to show an example of a process to form an organic EL element. Herein, this drawing shows the case of a manufacturing apparatus provided with two units of coating•drying sections, explanation of the coating•drying section will be omitted since it is same as one shown in FIG. 2.

In the drawing, 3 is a manufacturing apparatus to prepare an organic EL element. Manufacturing apparatus 3 is provided with a coating•drying section (same as coating•drying section 203 shown in FIG. 2) to form an organic compound layer constituting an organic EL element which is shown in FIG. 2 under an atmospheric pressure condition, cathode layer forming section 4 to form a cathode layer including the second electrode on the formed organic compound layer under a reduced pressure condition, sealing film paste up section 5 to paste up sealing film on the formed cathode layer sandwiching an adhesive under an atmospheric pressure condition, and recovery section 6.

In manufacturing apparatus 3 shown in this drawing to prepare an organic EL element, transport of an object is performed always in a roll form throughout each of coating•drying section 2—sealing film paste up section 5, and the object is recovered as a roll form wound on a core also in a recovery section. Herein, the object, after having been pasted up with sealing film, may be cut into a sheet form to be recovered.

Cathode layer forming section 4 is provided with material supply section 401, first cathode forming section 402, second cathode forming section 403 and second windup section 404, and the operation is continuously performed under a reduced pressure condition from supply section 401 until recovery section 404. In material supply section 401, flexible band substrate B201*f* of a roll form, which is comprised of an anode, a hole transport layer and an organic compound layer (an emission layer) formed on a flexible band substrate and has been wound up on a core, and which is prepared in manufacturing apparatus 2, is supplied.

Electron injection layer 201*g* is formed on the organic compound layer (the emission layer) of flexible band substrate B201*f* having an organic compound layer (an emission layer) unwound from supply section 401 in first cathode layer forming section 402. 402*a* is an evaporation apparatus and 402*b* is an evaporation source container.

In second cathode layer forming section 403, cathode layer 201*h*, which is the second electrode, is formed on electron injection layer 201*g* in second cathode layer forming section 403. 403*a* is an evaporation apparatus and 403*b* is an evaporation source container.

Flexible band substrate C201*i*, on which cathode layer 201*h*, which is the second electrode, is formed in second cathode layer forming section 403, is wound up on a core to be flexible band substrate C201*j* of a roll form.

In this drawing, the case of first cathode layer forming section 402 and second cathode layer forming section 403 being an evaporation apparatus is shown, however, a cathode layer forming method is not specifically limited and such as a sputtering method, a reactive sputtering method, a molecular beam epitaxy method, a cluster ion beam method, an ion plating method, a plasma polymerization method, an atmospheric pressure plasma polymerization method, a plasma CVD method, a laser CVD method, a thermal CVD method and a coating method can be utilized.

Sealing film paste up section 5 is provided with material supply section 501, paste up section 502 and recovery section 503, and the operation can be continuously performed under an atmospheric pressure condition from supply section 501 until recovery section 6. In supply section 501, flexible band substrate C201*j* of a roll form, which is comprised of an anode, a hole transport layer, an organic compound layer (an emission layer), an electron injection layer and a cathode layer formed on flexible band substrate C201*i* and has been wound up on a core, and which is prepared in cathode layer forming section 4, is supplied. Herein, sealing film paste up process 5 is preferably performed under an inert gas environment to prevent deterioration of an organic compound layer (an emission layer).

Paste up section 502 is provided with coating apparatus 502*a* to coat an adhesive on a cathode layer of flexible band substrate C201*i* which is fed from supply section 501, sealing film supply section 502*b*, press roll 502*c* and curing treatment section 502*d*. 502*b*1 is sealing film of a roll form having been wound up on a core.

Flexible band substrate C201*i* unwound from supply section 501, after having been coated with an adhesive on the cathode layer of said substrate C201*i* in a coating apparatus 502*a*, is continuously pasted up with sealing film and passed through press roll 502*c*, whereby sealing film is continuously pasted up on a cathode layer sandwiching an adhesive. A curing treatment of paste up of sealing film is performed after sealing film 502*b*2 has been pasted up sandwiching an adhesive. An organic EL element protected with sealing film 502*b*2 is prepared at the stage of finishing the curing treatment of an adhesive, and is wound on a core to make a roll form in recovery section 6 to complete preparation of organic EL element 601 of a roll form protected with sealing film. In this case, after pasting up sealing film, organic EL element may be cut into a sheet form without being wound. Other symbols are identical with those in FIG. 2.

An electron injection layer formed in first cathode forming section 402 is comprised of a material having a function to transport an electron and is included in an electron transport layer in a broad meaning. An electron injection layer is a layer provided between an electrode and an organic layer to decrease drive voltage and improve emission luminance, and is described in detail in 2nd volume 2nd chapter "Electrode Material" (pp. 123-166) of "Organic EL Element and Front Line of Industrialization Thereof (published by N. T. S. Corp., Nov. 30, 1998)". An electron injection layer (a cathode buffer layer) is detailed in JP-A Nos. 6-325871, 9-17574 and 10-74586, and specifically includes such as a metal buffer layer represented by such as strontium and aluminum, an alkali metal compound buffer layer represented by lithium fluoride, an alkaline earth metal compound buffer layer represented by magnesium fluoride, and an oxide buffer layer represented by aluminum oxide. The above-described buffer layer (an injection layer) is desirably very thin film, and preferably has a layer thickness in a range of 1 nm-5 μm although it depends on a material. An electron transport material (also functions as a hole block material) utilized in an electron transport layer adjacent to the cathode side is provided with a function to transmit an electron injected from a cathode to an emission layer, and a material utilized can be arbitrary one selected among conventionally known compounds and includes such as nitro substituted fluorene derivatives, diphenyl quinone derivatives, thiopyrandoxide derivatives, carbodiimide, fluorenylidene methane derivatives, anthraquinone dimethane and anthrone derivatives and oxadiazole derivatives. Further, thiadiazole derivatives in which an oxygen atom of an oxadiazole ring is substituted by a sulfur atom in the above described oxadiazole derivatives, and quinoxaline derivatives which has a quinoxaline ring known as an electron attractive group, can be utilized as an electron transport material. Further polymer material in which these materials are introduced in a polymer chain or utilized as a polymer main chain can be also utilized.

Further, metal complexes of an 8-quinolinol derivative such as tris(8-quinolinol)aluminum (Alq), tris(5,7-dichloro-8-quinolinol)aluminum, tris(5,7-dibromo-8-quinolinol)aluminum, tris(2-methyl-8-quinolinol)aluminum, tris(5-methyl-8-quinolinol)aluminum and bis(8-quinolinol)zinc (Znq), and in addition to these, metal complexes in which the central metal of these metal complexes is replaced by In, Mg, Cu, Ca, Sn, Ga or Pb can be also utilized as an electron transport material. Further, a distyrylpyradine derivative can be also utilized as an electron transport material, and similar to the cases of a hole injection layer and a hole transport layer, inorganic semiconductors of such as n-type Si and n-type SiC can be also utilized as an electron transport material. The layer thickness of an electron transport layer is not specifically limited; however, is generally approximately 5 nm-5 μm and preferably 5-200 nm. An electron transport layer may have one layer structure comprising one or at least two types of the above-described materials. Further, an electron transport layer which is doped with impurities to have a high n-property may be also utilized. Such examples includes those described in such as JP-A Nos. 4-297076, 10-270172, 2000-196140 and 2001-102175, and J. Appl. Phys., 95, 5773 (2004). To utilize such an electron transport layer having a high n-property is preferred because an element exhibiting low power consumption can be prepared. An electron transport layer can be also formed by making the above-described electron transport material into a thin film by a method well known in the art such as a wet coating method and a vacuum evaporation method. In the present invention, for example, an electron transport layer can be also formed by arranging second coating•drying section 206 and second heat treatment section 207 after third static elimination means 208.

As a cathode, those comprising a metal having a small work function (not more than 4 eV) (referred to as an electron injecting metal), an alloy, an electric conductive compound and a mixture thereof as an electrode substance are utilized. Specific examples of such an electrode substance include such as sodium, a sodium-potassium alloy, magnesium, lithium, a magnesium/copper mixture, a magnesium/silver mixture, a magnesium/aluminum mixture, a magnesium/indium mixture, an aluminum/aluminum oxide ($Al_2O_3$) mixture, indium, a lithium/aluminum mixture and a rare earth metal. Among them, preferable is a mixture of an electron injecting metal and the second metal, which has a work function larger than said metal and is stable, such as a magnesium/silver mixture, a magnesium/aluminum mixture, a magnesium/indium mixture, an aluminum/aluminum oxide ($Al_2O_3$) mixture, a lithium/aluminum mixture and aluminum are preferable. A cathode can be prepared by making these electrode substances into thin film by means of evaporation or sputtering. Further a sheet resistance as a cathode is not more than a few hundreds Ω/□, a layer thickness is generally selected in a range of 10 nm-5 μm and preferably in a range of 50-200 nm. Herein, to transmit emitted light, it is convenient to improve emission luminance provided that either one of an anode or a cathode of an organic EL element is transparent or translucent.

Further, after a cathode has been prepared with the above-described metal at a layer thickness of 1-20 nm, by forming a conductive transparent material, which was described in the explanation of an anode, thereon, it is possible to prepare a transparent or translucent cathode, whereby an element, the both an anode and an cathode of which provided with transparency, can be prepared.

As sealing film, barrier film made of the same material as gas barrier film, and metal thin film can be employed. An adhesive specifically includes photo-curing and thermal-curing type adhesive having a reactive vinyl group such as acrylic acid type oligomer and methacrylic acid type oligomer; an adhesive of a moisture-curing type such as 2-cyanoacrylic acid ester; a thermal and photo-curing type adhesive such as an epoxy type; a hot melt type adhesive such as a polyamide type, a polyester type and a polyolefin type; and an ultraviolet curing type epoxy resin adhesive of a cationic curing type.

Herein, since an organic compound layer may be deteriorated by a heat treatment, adhesion and curing is preferably performed from room temperature to 80° C. Further, a drying agent may be dispersed in the aforesaid adhesives. To coat an adhesive on the sealing portion, a die coat method and a printing method can be employed.

As shown in this drawing, a process to coat by a wet coating method under atmospheric pressure to form coated film for an organic compound layer, a process to form an electron injection layer and a cathode layer on the organic compound layer under a reduced pressure condition, and a process to paste up sealing film on the cathode layer under atmospheric pressure are provided, transfer of an object between each process being performed in a roll form, and organic EL element is prepared via each process thereof, whereby the following effects can be obtained in addition to the effect of organic compound layer forming method shown in FIG. 2.

1) By separating a coating•drying process to form an organic compound layer, a cathode layer forming process to form an cathode layer including the second electrode and a sealing film paste up process, optimization in each process becomes easy to enable achievement of stable quality as well as improvement of productivity.

2) Using efficiency of an organic compound utilized to form one or a plural number of emission layers comprising an organic substance is high resulting in depression of a cost.

Figure 4:
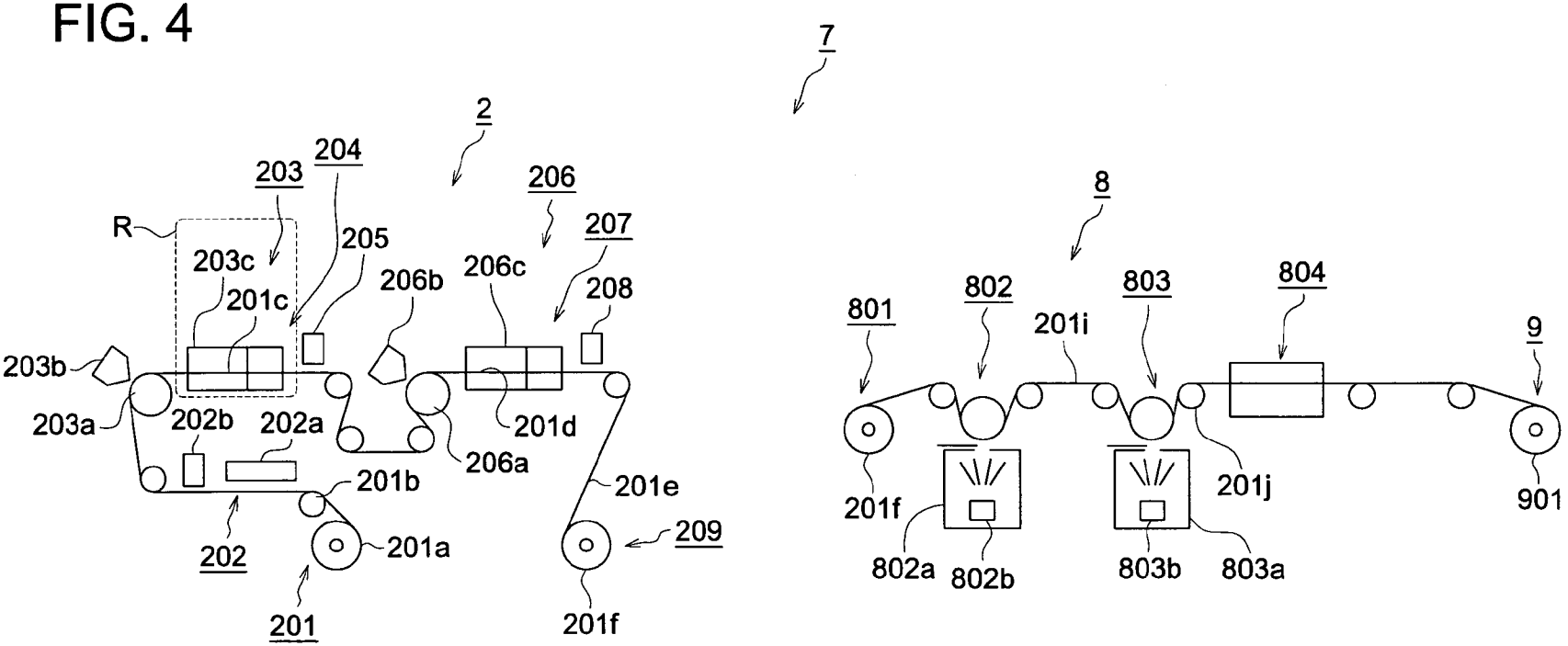
FIG. 4 is a schematic drawing to show another example of a process to prepare an organic EL element.

FIG. 4 is a schematic drawing to show another example of a process to prepare an organic EL element. Herein, this drawing shows the case of a manufacturing apparatus provided with two units of coating•drying sections; and the explanation will be omitted since the coating•drying section is same as one shown in FIG. 2.

In the drawing, 7 is a manufacturing apparatus to prepare an organic EL element. Manufacturing apparatus 7 is provided with a coating•drying section (identical with coating•drying section 203 shown in FIG. 2) to form an organic compound layer constituting an organic EL element shown in FIG. 2 under an atmospheric pressure condition, cathode layer-sealing layer forming section 8 to form a cathode layer including the second electrode on the formed organic compound layer under a reduced pressure condition, and recovery section 9. In manufacturing apparatus 7 shown in this drawing to prepare an organic EL element, transfer of an object between each coating•drying section 2 and cathode-sealing layer forming section 8 is performed in a roll form, and in a recovery section an object is recovered also as a roll form wound on a core.

Cathode layer•sealing layer forming section 8 is provided with supply section 801, first cathode layer forming section 802, second cathode layer forming section 803, sealing layer forming section 804 and recovery section 9, and the process is continuously performed under a reduced pressure condition from material supply section 801 until recovery section 9. In material supply section 801, flexible band substrate B201*f* of a roll form, which is prepared in manufacturing apparatus 2, and which is comprised of an anode, a hole transport layer and an organic compound layer are formed on a flexible band substrate to be wound on a core, is supplied.

Electron injection layer 201*i* is formed on an organic compound layer (an emission layer) of flexible band substrate B201*f*, which is provided with an organic compound layer (an emission layer) and unwound from supply section 801, in first cathode layer forming section 802. 802*a* is an evaporation apparatus and 802*b* is an evaporation source container.

In second cathode layer forming section 803, cathode layer 201*j* is formed on electron injection layer 201*i* which has been formed in first cathode layer forming section. 803*a* is an evaporation apparatus and 803*b* is an evaporation source container. In sealing layer forming section 804, a sealing layer is formed on a cathode layer to prepare an organic EL element protected with a sealing layer, which is wound on a core in recovery section 9 to be made into a roll form, whereby preparation of organic EL element 901 of a roll form protected with sealing film is completed. Other symbols are identical those in FIG. 2.

In sealing layer forming section 804 shown in this drawing, preferable is a method to provide inorganic and organic layers on the outside of a cathode layer to form sealing film. In this case, a film forming material is a material provided having a function to restrain invasion of matters which may cause deterioration of an element such as moisture and oxygen, and such as silicon oxide, silicon dioxide and silicon nitride can be utilized.

As shown in this drawing, a process to coat and form coated film for an organic compound layer by a wet coating method under atmospheric pressure, a process to form an electron injection layer, a cathode layer and a sealing layer on the organic compound layer under a reduced pressure condition are provided, transfer of an object between each process being performed in a roll form, and organic EL element is prepared via each process thereof, whereby the following effects can be obtained in addition to the effect of organic compound layer forming method shown in FIG. 2.

1) By separating a coating•drying process to form an organic compound layer, a cathode layer forming process to form an cathode layer including the second electrode and a sealing film paste up process, optimization in each process becomes easy to enable achievement of stable quality as well as improvement of productivity.

2) Using efficiency of an organic compound utilized to form one or a plural number of emission layers comprising an organic substance is high resulting in depression of a cost.

Figure 5:
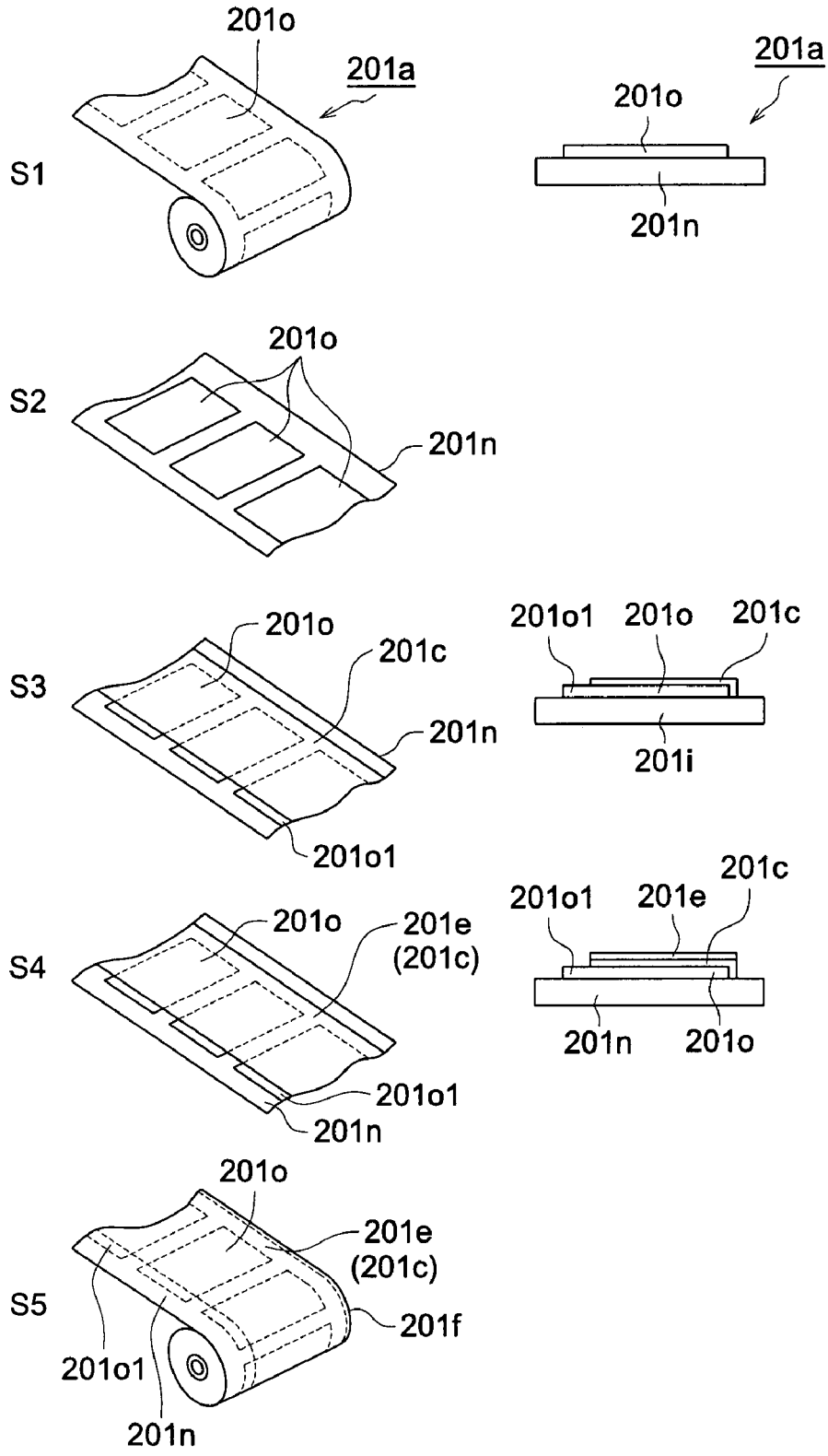
FIG. 5 is a schematic flow diagram to form until an organic compound layer by use of a process to form until an organic compound layer shown in FIG. 2.

FIG. 5 is a brief flow diagram to form until an organic compound layer by use of a manufacturing apparatus to form up to an organic compound layer shown in FIG. 2.

In S1, flexible band substrate 201*a*, on which an anode layer including the first electrode having been formed, of a roll form is provided to a supply section. Flexible band substrate 201*n* shown in this drawing is already in a state of first electrode layer 201*o* having been formed thereon. First electrode layer 201*o* has been formed on the barrier layer of flexible band substrate 201*n* continuously along the longitudinal direction at a predetermined size and an interval. Herein, a barrier layer may be provided between flexible band substrate 201*n* and first electrode layer 201*o*. In this case a barrier layer is formed all over the surface of flexible band substrate 201*n*. Flexible band substrate 201*a* of a roll form is in a state of having been wound making first electrode layer 201*o* inside.

In S2, a washing surface modification treatment of a flexible band substrate, which has been unwound from a substrate supply section is carried out, at a washing surface modification treatment section.

In S3, a first organic compound layer (a hole transport layer) coating solution is coated by a wet coater at first coating section under atmospheric pressure. At this time, a first organic compound layer (a hole transport layer) coating solution is coated except on the edge portion 201*o*1 of first electrode layer 201*o*. After coating, drying is carried out by the first dryer in the first dryer section to form first organic compound layer (hole transport layer) 201*c*. Successively, a heat treatment of the first organic compound layer (hole transport layer) is carried out by the first heating treatment apparatus. Then, static elimination treatment of the surface of the formed hole transport layer is carried out by a static elimination means.

In S4, a second organic compound layer (emission layer) coating solution is coated on formed first organic compound layer (hole transport layer) 201*c* by a wet coater in the second coating section under atmospheric pressure and drying is carried out by the second dryer in the second drying section resulting in formation of second organic compound layer (emission layer) 201*d*. Successively, a heat treatment of second organic compound layer (emission layer) 201*e* is carried out by the second heat treatment apparatus. Second organic compound layer (emission layer) 201*d* is coated at the same coating width as first organic compound layer (hole transport layer) 201*c*. Herein, in the case of a plural number of second organic compound layers (emission layers) being provided, accumulated second organic compound layers (emission layers) are formed by repeating coating•drying•heat treatment corresponding to the number of second organic compound layers (emission layers) to be accumulated. Then, static elimination of the formed second organic compound layer (emission layer) 201*e* is carried out by a static elimination means.

In S5, a flexible band substrate having the second organic compound layer (emission layer) is kept, until being transferred to the next process, under a reduced pressure condition of $10^{-5}$-10 Pa as a form of flexible band substrate 201*h* of a roll form wound on a core making the second organic compound layer (emission layer) inside.

Figure 6:
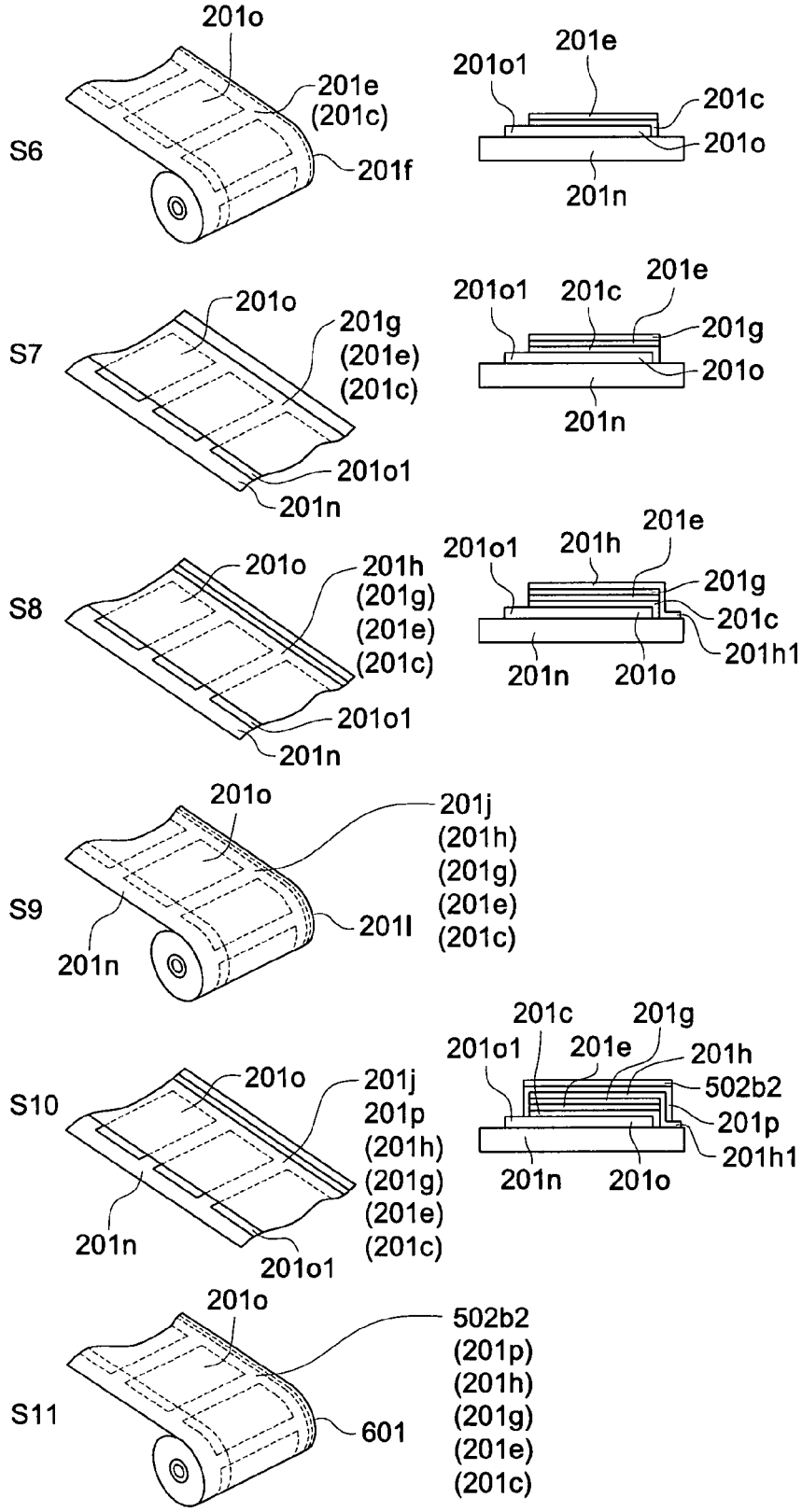
FIG. 6 is a schematic flow diagram to manufacture an organic EL element by use of a process to form an organic EL element shown in FIG. 3.

FIG. 6 is a brief flow diagram of manufacturing of an organic EL element utilizing a process to manufacture an organic EL element shown in FIG. 3. Herein, since processes up to formation of an organic compound layer (emission layer) are identical with S1-S5 shown in FIG. 5, the explanation will be omitted.

In S'1, flexible band substrate provided with second organic compound layer (emission layer) 201*e* shown in S5 of FIG. 5 is wound on a core to prepare flexible band substrate 201*f* of a roll from.

In S'2, electron injection layer (LiF layer) 201*g* having a thickness of 0.5 nm is formed on the second organic compound layer (emission layer) 201*e* of a flexible band substrate by an evaporation method under a reduced pressure condition of $5\times10^{-4}$ Pa. Formation of an electron injection layer is carried out in a state of arranging a mask so as not to cover the one edge portion 201*o*1 of first electrode layer 201*o* at the time of evaporation.

In S'3, electron injection layer 201*i* and second electrode layer (aluminum layer) 201*h* having a thickness of 100 nm are formed on formed electron injection layer 201*g* by an evaporation method under a reduced pressure condition of $5\times10^{-4}$ Pa. The second electrode layer is formed so as to make the edge portion opposite to one edge portion 201*o*1 broader than the width of the electron injection layer and on flexible band substrate 201*n*.

In S'4, a flexible band substrate, on which a cathode layer including the second electrode (electron injection layer 201*g* and second electrode layer 201*h*) has been formed, is wound on a core under a reduced pressure condition to be flexible band substrate 201*j* of a roll form, which is transferred to the next process.

In S'5, adhesive 201*p* is coated under atmospheric pressure so as to cover a cathode layer including the second electrode except one edge portion 201*o*1 of the first electrode layer and edge portion 201*h*1 of the cathode layer including the second electrode. As an adhesive, for example, UV curable epoxy resin (UV Resin NXR5570-B1, manufactured by Nagase Chemtex Co., Ltd) was coated by a die coater. Successively, sealing film 502*b*2, which is supplied from sealing film supply portion, is pasted up to meet the area of the coated adhesive, being pressed by a press roll, and a curing treatment is carried out by irradiation from the cathode side with an UV lamp, whereby a flexible band substrate on which an organic EL element is formed (an organic EL element protected by sealing film) is prepared. Herein, epoxy resin of an adhesive may be a heat-curable type. In this case, heat press is carried out by being passed between heat rolls at the time of paste up.

In S'6, a flexible band substrate (an organic EL element protected by sealing film) is wound up on a core to make a roll form, whereby preparation of organic EL element 601 of a roll form protected by seal film is completed. Herein, the finished substrate may be appropriately cut into a sheet form corresponding to the size of the first electrode layer. In the case of being cut, an adhesive is preferably applied only on the outer circumference of organic compound layer (emission layer) by means of such as a dispenser or a screen printing method.

Figure 7:
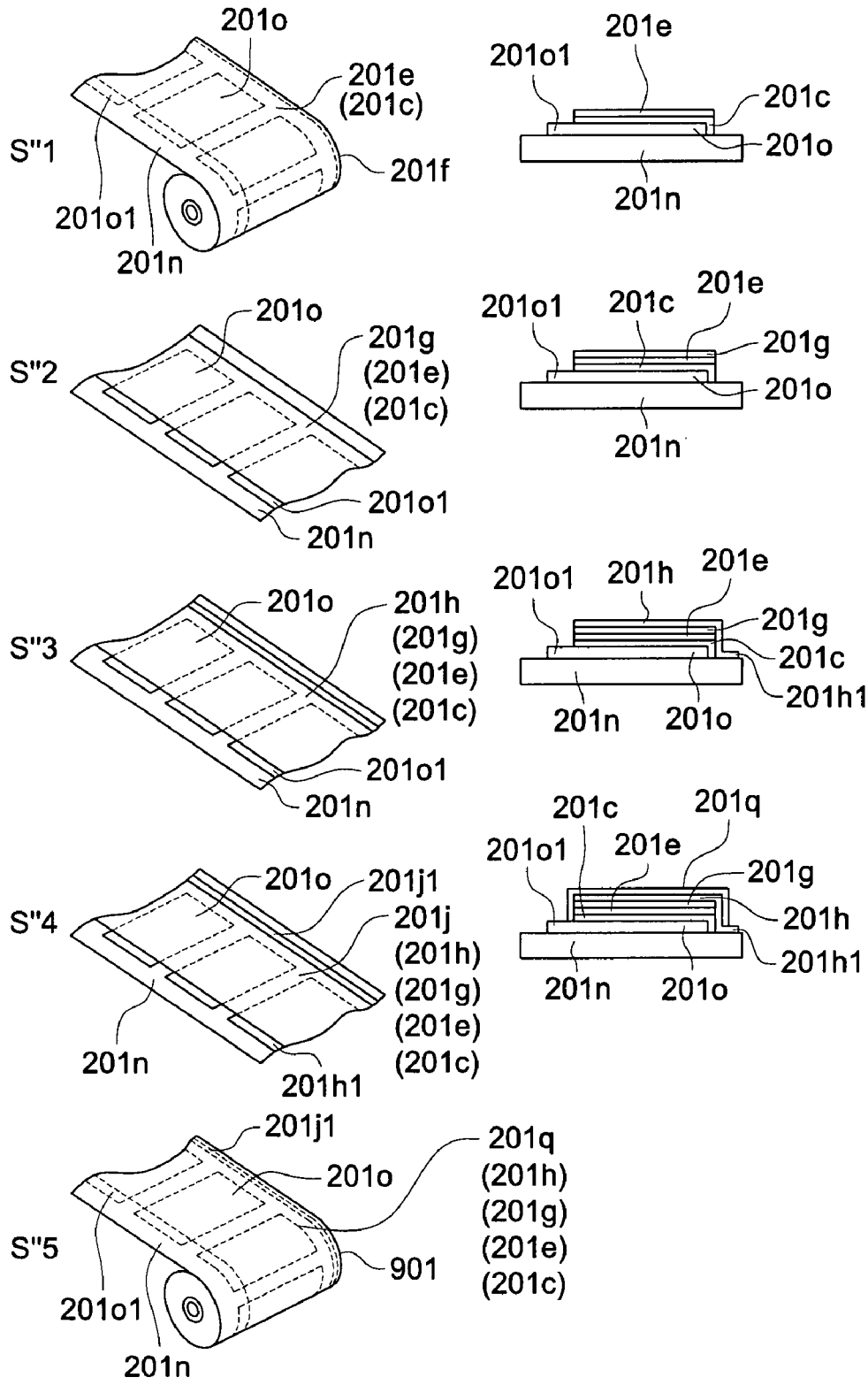
FIG. 7 is a schematic flow diagram to manufacture an organic EL element by use of a process to form an organic EL element shown in FIG. 4.

FIG. 7 is a brief flow diagram of manufacturing an organic EL element utilizing processes to manufacture an organic EL element shown in FIG. 4. Herein, since processes up to formation of an organic compound layer (emission layer) are identical with S1-S5 shown in FIG. 5, the explanation will be omitted.

In S"1, a flexible band substrate provided with second organic compound layer (emission layer) shown in S5 of FIG. 5 is wound on a core to prepare flexible band substrate of a roll form 201*f*.

In S"2, electron injection layer (LiF layer) 201*g* having a thickness of 0.5 nm is formed on the second organic compound layer (emission layer) 201*e* of a flexible band substrate by an evaporation method under a reduced pressure condition of $5\times10^{-4}$ Pa. Formation of an electron injection layer is carried out in a state of arranging a mask so as not to cover the one edge portion 201*o*1 of first electrode layer 201*o* at the time of evaporation.

In S"3, second electrode layer (aluminum layer) 201*h* having a thickness of 100 nm is formed on formed electron injection layer 201*g* by an evaporation method under a reduced pressure condition of $5\times10^{-4}$ Pa. The second electrode layer is formed so as to make the edge portion opposite to one edge portion 201*o*1 broader than the width of the electron injection layer and on flexible band substrate 201*n*.

In S"4, successively on formed electron injection layer (cathode layer) 201*h*, sealing layer 201*q* is formed under a reduced pressure condition so as to cover second electrode layer 201*j* except one edge portion 201*o*1 of first electrode layer (anode layer) 201*o* and one edge portion 201*h*1 of second electrode layer (cathode layer) 201*h*, whereby a flexible band substrate, on which an organic EL element has been formed, is prepared.

In S"5, a flexible band substrate (an organic EL element protected by sealing film) is wound up on a core to make a roll form, whereby preparation of organic EL element 601 of a roll form protected by seal film is completed. Herein, the finished substrate may be appropriately cut into a sheet form corresponding to the size of the first electrode layer. In the case of being cut, an adhesive is preferably applied only on the outer circumference of organic compound layer (emission layer) by means of such as a dispenser or a screen printing method.

Thereafter, the finished substrate may be continuously cut into a sheet form corresponding to the size of the first electrode layer, or may be once wound on a core to be a roll form.

Next, other constituent materials utilized to constitute an organic EL element according to the present invention will be explained. A layer arranged adjacently to an organic compound layer (emission layer) includes a block layer. A block layer includes a hole block layer and an electron block layer. A block layer is appropriately arranged in addition to basic constituent layers of organic compound thin film. For example, listed is a hole block layer described in such as JP-A Nos. 11-204258 and 11-204359 and p. 237 of "Organic EL Element and Front Line of Industrialization Thereof (published by N. T. S Corp., Nov. 30, 1998)". A hole block layer has a function of an electron transport layer in the broad meaning, being comprised of a material, which has a function to transport an electron but has very little ability to transport a hole, and capable of improving recombination probability of an electron and a hole by blocking a hole while transporting an electron. Further, a constitution of an electron transport layer, which will be described later, may be appropriately utilized as a hole block layer according to the present invention, and a hole block layer is preferably arranged adjacently to an organic compound layer (emission layer).

When an organic compound layer (emission layer) is comprised of a plural number of emission layers of different emission colors, an emission layer, an emission maximum wavelength of which is shortest, is preferably arranged nearest to an anode among the all emission layers, however, in such a case, a hole block layer is preferably additionally arranged between said shortest wavelength layer and an emission layer second nearest to an anode. Further, not less than 50 weight % of a compound contained in a hole block layer arranged at said position has a larger ionization potential by not less than 0.3 eV against a host compound of the aforesaid shortest wavelength layer.

An ionization potential is defined by an energy required to release an electron existing on the HOMO (highest occupied molecular orbit) level to a vacuum level, and for example, can be determined according to the following method. (1) By use of Gaussian 98 (Gaussian 98, Revision A. 11. 4, M. J. Frisch, et al, Gaussian, Inc., Pittsburgh Pa., 2002), which is a molecular orbit calculation software manufactured by Gaussian, Inc., USA; a value calculated by performing structural optimization (converted value of eV unit), the second place of decimals of which is rounded off, is defined as an ionization potential. (2) An ionization potential can be also determined by being directly measured by means of photoelectron spectroscopy. Foe example, a low energy electron spectrometer "Model AC-1" manufactured by Riken Keiki Co., Ltd., or a method known as ultraviolet photoelectron spectroscopy can be preferably utilized.

On the other hand, an electron block layer has a function of a hole transport layer in the broad meaning, being comprised of a material which has a function to transport a hole but has very little ability to transport an electron, and capable of improving recombination probability of an electron and a hole by blocking an electron while transporting a hole. Further, a constitution of a hole transport layer, which will be described later, may be appropriately utilized as an electron block layer. The layer thickness of a hole block layer and an electron transport layer, according to the present invention, is preferably 3-100 nm and more preferably 5-30 nm.

In an organic compound layer (emission layer) constituting an organic EL element of the present invention, a host compound well known in the art and a phosphorescent compound (also referred to as a phosphorescence emitting compound) well known in the art are preferably incorporated to increase emission efficiency of an organic compound layer (emission layer).

A host compound is defined as a compound, which occupies not less than 20 weight % in the layer based on a weight ratio among compounds contained in an emission layer and has a phosphorescence quantum efficiency of phosphorescent emission at room temperature (25° C.) of less than 0.1. The phosphorescence quantum efficiency is preferably less than 0.01. Plural types of host compounds may be utilized together. By utilizing plural types of host compounds, it is possible to control charge transfer and to prepare an organic EL having high efficiency. Further, by utilizing plural types of phosphorescent compounds, it becomes possible to mix different emission resulting in enabling to obtain an arbitrary emission color. By adjusting a type and a doping amount of a phosphorescent compound, it is possible to obtain white emission, which can be applied for illumination and backlight.

As these host compounds, preferable is a compound which has hole transport ability and electron transport ability, as well as prevents emission from going to a longer wavelength and further has a high Tg (glass transition temperature). Host compounds well known in the art include compounds described in such as JP-A Nos. 2001-257076, 2002-308855, 2001-313179, 2002-319491, 2001-357977, 2002-334786, 2002-8860, 2002-334787, 2002-15871, 2002-334788, 2002-43056, 2002-334789, 2002-75645, 2002-338579, 2002-105445, 2002-343568, 2002-141173, 2002-352957, 2002-203683, 2002-363227, 2002-231453, 2003-3165, 2002-234888, 2003-27048, 2002-255934, 2002-260861, 2002-280183, 2002-299060, 2002-302516, 2002-305083, 2002-305084 and 2002-308837.

In the case that an organic compound layer (emission layer) is provided with a plural number of emission layers, it is preferable that not less than 50 weight % of host compounds of these layers are the same compound with respect to easily achieving a homogeneous film properties all over the organic layer, and it is further preferable that a phosphorescence emission energy of a host compound is not less than 2.9 eV because it is advantageous to efficiently restrain energy transfer from a dopant and to obtain high luminance. Phosphorescent emission energy refers to a peak energy of the 0-0 band of phosphorescence emission when a photoluminescence is measured by forming an evaporated film of a host compound having a thickness of 100 nm.

A host compound preferably has a phosphoresce emission energy of not less than 2.9 eV and Tg of not lower than 90° C. in consideration of such as deterioration of an organic EL element at aging (luminance decrease, deterioration of film properties) and market needs as a light source. That is, to satisfy the both of luminance and durability, those having phosphorescence emission energy of not less than 2.9 eV and Tg of not lower than 90° C. are preferable. Tg is furthermore preferably not lower than 100° C.

A phosphorescent compound (phosphorescence emitting compound) is a compound in which emission from an exited triplet state is observed and which emits phosphorescence at room temperature (25° C.), and is a compound having a phosphorescence quantum yield at 25° C. of not less than 0.01. By utilizing a phosphorescent compound together with a host compound explained before, an organic EL element having further higher emission efficiency can be prepared.

A phosphorescent compound according to the present invention preferably has a phosphorescence quantum yield of not less than 0.1. The above-described phosphorescence quantum yield can be measured by a method described at p. 398 of Spectroscopy II of the 4th edition Experimental Chemistry Course 7 (Maruzen, 1992). A phosphorescence quantum yield in a solution can be measured employing various types of solvents; however, it is preferred that a phosphorescent compound utilized in the present invention achieves the above-described phosphorescence quantum yield in any one of arbitrary solvents.

A principle of emission of a phosphorescent compound includes two types; one is an energy transfer type in which recombination of a carrier is caused on a host compound, which transport a carrier, to generate an exited state of a host compound and this energy is transferred to a phosphorescent compound resulting in obtaining emission from the phosphorescent compound, and the other is a carrier trap type in which a phosphorescent compound functions as a carrier trap to cause recombination of a carrier on a phosphorescent compound resulting in obtaining emission; however, in either case, it is necessary that energy of an exited state of a phosphorescent compound is lower than energy of an exited state of a host compound.

A phosphorescent compound can be utilized by being appropriately selected among those well known in the art and utilized in an emission layer of an organic EL element. A phosphorescent compound is preferably a complex type compound containing a metal of the 8-10th groups of the periodic table of elements, more preferably an iridium compound, an osmium compound, a platinum compound (a platinum complex type compound) or a rare earth compound, and most preferably among them an iridium compound.

In the present invention, the phosphorescence emission maximum wavelength of a phosphorescent compound is not specifically limited, and the emission wavelength obtained can be principally varied by selecting the central metal, the ligand and the substitution position of the ligand.

Color of emission from an organic EL element of the present invention and from a compound according to the present invention is determined by a color when a measured result by use of Spectral Radiation Luminance Meter CS-1000 (manufactured by Konicaminolta Sensing Corp.) according to p. 108, FIG. 4.16 in "New Edition Color Science Handbook" (Edited by Japan Color Society, Tokyo University Publishing Association, 1985) is applied into CIE chromaticity coordinates.

A white element in the present invention refers that chromaticity in CIE 1931 color specification system at 1,000 $Cd/m^2$, when a front luminance at 2° viewing angle is measured by the above-described method, is within a region of $X=0.33\pm0.07$, $Y=0.33\pm0.07$.

Take out efficiency of an organic EL element of the present invention at room temperature is preferably not less than 1%, and more preferably not less than 5%. Herein, take out quantum efficiency (%)=a number of photons emitted outside of an organic EL element/a number of electrons flown in an organic EL element×100.

Further, a hue improving filter such as a color filter may be utilized together, and a color conversion filter, which converts emission color from an organic EL element into multicolor by use of a fluorescent substance, may be also utilized together. In the case of utilizing a color conversion filter, $\lambda$max of emission of an organic EL element is preferably not more than 480 nm.

In a gap between a sealing member (a sealing layer or sealing film shown in FIG. 1) and a display region of an organic EL element, an inert gas such as nitrogen and argon, or an inert liquid such as hydrogen fluoride and silicone oil is preferably injected, as a gas phase and a liquid phase. Further, it can be made vacuum. Further, the inside can be filled with a hygroscopic compound. A hygroscopic compound includes such as metal oxide (such as sodium oxide, potassium oxide, calcium oxide, barium oxide, magnesium oxide and aluminum oxide), sulfate (such as sodium sulfate, calcium sulfate, magnesium sulfate and cobalt sulfate), metal halogenide (calcium chloride, magnesium chloride, cesium fluoride, tantalum fluoride, cerium bromide, magnesium bromide, barium iodide and magnesium iodide) and perchlorates (such as barium perchlorate and magnesium perchlorate); and salt anhydride is preferably utilized as sulfate, metal halogenide and perchlorates.

An organic EL element of the present invention preferably employs together the following method to efficiently take out light generated in an emission layer. In an organic EL element, it is generally said that emission is generated at the inside of a layer having a refractive index higher than air (refractive index of approximately 1.7-2.1) and only 15-20% of light generated in an emission layer can be taken out. This is because light incident into the interface at an angle $\theta$ over the critical angle causes total reflection to unable to be taken out of an element, and because light causes total reflection between a transparent electrode or an emission layer and a transparent substrate to be guided through the transparent electrode or the emission layer resulting in making light escape to the side surface direction of an element.

As a method to improve this take out efficiency of light includes, for example, a method roughness is formed on the transparent substrate surface to prevent total reflection at the interface of a transparent substrate and air (U.S. Pat. No. 4,774,435), a method to improve the efficiency by providing a substrate with a condensing property (JP-A 63-314795), a method to form a reflective plane on such as the side surface of an element (JP-A 1-220394), a method to introduce a flat layer having an intermediate refractive index between a substrate and a fluorescent substance to form anti-reflection film (JP-A 62-172691), a method to introduce a flat layer having a refractive index lower than that of a substrate between a substrate and a fluorescent substance (JP-A 2001-202827), and a method to form a diffraction grating at the interlayer of any one of a substrate, a transparent electrode and an emission layer (including the interface between a substrate and the outside) (JP-A 11-283751).

In the present invention, these methods can be utilized in combination with an organic EL element, however, a method to introduce a flat layer having a refractive index lower than that of a substrate between a substrate and a fluorescent substance or a method to form a diffraction grating at the inter-layer of any one of a substrate, a transparent electrode and an emission layer (including the interface between a substrate and the outside) is preferably utilized. In the present invention, by combining these methods, an element having further high luminance or excellent durability can be prepared.

In the case that a medium having a low refractive index is formed between a transparent electrode and a transparent substrate at a thickness of longer than a wavelength of light, light emitted from the transparent electrode has the higher efficiency of taking out when a refractive index of a medium is the lower. A low refractive index layer includes such as aerogel, porous silica, magnesium fluoride and fluorine-containing polymer. Since a refractive index of a transparent substrate is generally approximately 1.5-1.7, a low refractive index layer preferably has a refractive index of approximately not more than 1.5 and more preferably of not more than 1.35. A thickness of a low refractive index layer is preferably at least twice of a wavelength in the medium. This is because an effect of a low refractive index layer will be decreased when a thickness of a low refractive index becomes approximately as large as a wavelength of light making electromagnetic waves bleeding out by evanescent to invade into a substrate. A method to introduce a diffraction grating to the interface or either medium which causes total reflection is characterized by a high improvement effect of taking out of light. In this method, by utilizing a property to change the direction of light into a specific direction different from refraction by so-called Bragg's diffraction such as primary diffraction and secondary diffraction, light which cannot go out due to such as total reflection between layers among light generated from an emission layer is made to be diffracted by introduction of a diffraction grating to any of inter-layers or in a medium (such as a transparent substrate or a transparent electrode), whereby light will be taken out. A diffraction grating introduced is preferably provided with a two dimensional periodic refractive index. This is because light emitted in an emission layer will be randomly generated in all directions and only light advancing a specific direction is diffracted by an ordinary one-dimensional diffraction grating, which has a diffractive index distribution only in a certain direction, resulting in not so much increase of taking out efficiency of light. However, by making the refractive index distribution two-dimensionally, light advancing all directions will be diffracted to increase taking out efficiency of light.

The position to introduce a diffraction grating may be either any one of inter-layers or in media (in a transparent substrate or in a transparent electrode), however, is desirably the neighborhood of an organic emission layer where light is generated. In this case, the period of a diffraction grating is preferably approximately ½-3 times of a wavelength of light in the medium. The arrangement of a diffraction grating is preferably those in which an arrangement is repeated two dimensionally such as a square lattice form, a triangle lattice form and a honeycomb lattice form.

Further, an organic EL element of the present invention can be made to have higher luminance in a specific direction by such as processing to provide a structure of a micro-lens form on the light take out side of a substrate, or by such as condensing light to the front direction against an element emission plane. As an example of a micro-lens alley, a square pyramid is arranged two-dimensionally so as to make one edge of 30 μm and the peak angle of 90 degree on the light take out side of a substrate. One edge is preferably 10-100 μm. An effect of diffraction will generate to cause coloring when it is not more than this, while it is not preferable to increase thickness when it is excessively large.

As a condenser sheet, for example, those practically employed in practice as an LED backlight of a liquid crystal display can be utilized. As such a sheet, for example, brightness enhancing film (BEF) manufactured by Sumitomo 3M Ltd. can be utilized. As a form of a prism sheet, for example, employed may be a form in which a stripe of a triangle form having a peak angle of 90 degree and a pitch of 50 μm are formed on a substrate, a form having a rounded peak angle, a form having randomly varying pitches or other forms. Further, a light scattering plate-film to control the light emission angle from an emission element may be utilized together. For example, Diffusion Film (Light Up) manufactured by Kimoto Co., Ltd. can be utilized.

In the following, specific effects will be shown referring to examples; however, embodiments of the present invention are not limited thereto.

EXAMPLES

Example 1

(Preparation of Flexible Band Substrate Provided with Gas Barrier Layer and First Electrode Layer in this Order)

A gas barrier layer and the first electrode layer were formed by the following method on polyether sulfone having a thickness of 200 μm (film manufactured by Sumitomo Bakelite Co., Ltd., hereinafter referred to as PES), which was wound on a core to be a roll from, whereby a flexible band substrate provided with a gas barrier layer and the first electrode layer in this order was prepared.

(Formation of Transparent Gas Barrier Layer)

A transparent gas barrier layer having a thickness of approximately 90 nm was formed on the prepared PES by an atmospheric pressure discharge treatment method. Water vapor permeability was measured by a method based on JISk-7129B to be not more than $10^{-3}$ g/m$^2$/day. Oxygen permeability was measured by a method based on JISk-7126B to be not more than $10^{-3}$ g/m$^2$/day.

(Formation of First Electrode Layer)

ITO (indium tin oxide) having a thickness of 120 nm was patterned by an evaporation method on the formed barrier layer, whereby the first electrode layer was formed.

(Formation of Organic Compound Layer (Emission Layer))

By utilizing a process shown in FIG. 2, a hole transport layer coating solution was coated•dried by means of a wet coating method utilizing an extrusion coater on the first electrode layer of the prepared flexible band substrate provided with a gas barrier layer and the first electrode layer in this order, a static elimination treatment being carried out, and successively an organic compound layer (emission layer) coating solution was coated-dried by means of a wet coating method utilizing an extrusion coater on the hole transport layer under the following condition changing a distribution of a transport speed at the time of coating the organic compound layer coating solution, as shown in table 1, to form an organic compound layer (emission layer); the resulting substrate being subjected to a static elimination treatment and wound on a core to be a roll form after having been cooled to room temperature, whereby sample Nos. 101-108 were prepared.

Herein, a transport speed was measured by Laser Doppler Speedometer LV 203, manufactured by Mitsubishi Electric Corp., and a distribution of a transport speed is a value indicated in % of a mean square root based on a mean speed. To change distribution of a transport speed was performed by varying a transport speed.

Before coating a hole transport layer coating solution, a washing surface modification treatment of a flexible band substrate was carried out by use of a low pressure mercury lamp having a wavelength of 184.9 nm at an irradiation strength of 15 mW/cm$^2$ and a distance of 10 mm. A static elimination treatment was carried out by use of a charge neutralizer employing very weak X rays.

A hole transport layer coating solution was coated so as to make a dry layer thickness of 50 nm. An organic compound layer coating solution was coated so as to make a dry layer thickness of 100 nm. Herein, transport speed was 2 m/min.

Preparation of Hole Transport Layer Coating Solution

A solution of polyethylene dioxythiophene•polystyrene sulfonate (PEDOT/PSS, Bytron P AI 4083, manufactured by Bayer Corp.), which had been diluted by 65% of pure water and 5% of methanol, was prepared as a hole transport layer coating solution. A surface tension of a hole transport layer coating solution was 0.04 Nm (Surface Tension Meter CBVP-A3, manufactured by Kyowa Interface Science Co., Ltd.).

Preparation of Organic Compound Layer Coating Solution

Polyvinylcarbazole as a host material and 5 weight % of dopant material Ir(ppy)3 were dissolved in 1,2-dichloroethane to make a 10% solution, whereby a organic compound layer coating solution was prepared. A surface tension of an organic compound layer coating solution was 0.032 Nm (Surface Tension Meter CBVP-A3, manufactured by Kyowa Interface Science Co., Ltd.). A glass transition temperature of an organic compound layer was 225° C. Herein, in this example, a material having green emission, however, a white emission organic EL element can be prepared by further accumulating layers employing blue and red materials together with a dopant material.

Drying and Heat Treatment Conditions

After coating a hole transport layer coating solution, by use of the first dryer and the first heat treatment apparatus shown in FIG. 2, the solvent was removed by ejecting air from an ejection outlet of a slit nozzle type toward the film formed surface, at a height of 100 mm, an air ejection velocity of 1 m/s, a variation of air ejection velocity in the width direction of 5% and a temperature of 100° C. in the first dryer, and successively, a heat treatment by a back-surface heat transmission method at a temperature of 200° C. was carried out in the first heat treatment apparatus, whereby a hole transport layer was formed.

After coating an organic compound layer (emission layer) coating solution, by use of the second dryer and the second heat treatment apparatus shown in FIG. 2, the solvent was removed by air ejection from an ejection outlet of a slit nozzle type toward the film formed surface, at a height of 100 mm, an air ejection velocity of 1 m/s, a variation of air ejection velocity in the width direction of 5% and a temperature of 60° C. in the second dryer, and successively, a heat treatment at a temperature of 220° C. was carried out in the second heat treatment apparatus, whereby an organic compound layer (emission layer) was formed.

Coating Condition

A temperature at the time of coating a hole transport layer coating solution was 25° C. and a temperature at the time of coating an organic compound layer coating solution was 25° C., under atmospheric environment. Herein a wet coating process was kept at a dew point of −20° C. and a cleanliness class of not more than 5 (JIS B 9920).

Evaluation

With respect to prepared sample Nos. 101-108, emission luminance unevenness was evaluated based on the following evaluation ranks and the result is shown in table 1.

Measurement Method of Emission Luminance Unevenness

Emission luminance was measured by use of CS-1000, manufactured by Konicaminolta Corp. when direct current voltage of 10 V was applied, and unevenness was determined by the following equation.

Emission luminance unevenness (%)=(maximum emission luminance−minimum emission luminance)/maximum emission luminance×100

Evaluation Ranks of Emission Luminance Unevenness

A: Emission luminance unevenness is less than 10%.

B: Emission luminance unevenness is not less than 10% and less than 15%.

C: Emission luminance unevenness is not less than 15%.

TABLE 1

| Sample No. | Variation of transport speed (%) | Emission luminance unevenness |
|---|---|---|
| 101 | 0.1 | A |
| 102 | 0.2 | A |
| 103 | 1.0 | A |
| 104 | 3.0 | A |
| 105 | 5.0 | A |
| 106 | 8.0 | A |
| 107 | 10.0 | A |
| 108 | 11.0 | B |

Herein, sample No. 101 showed an excellent evaluation result in emission luminance unevenness, however, since it is effective to increase a mean transport speed to restrain a distribution of a transport speed, a transport speed is increased to make drying apparatus large resulting in possible decrease of energy efficiency. Effectiveness of the present invention has been proved.

Example 2

An organic compound layer was formed in a similar manner to preparation of sample No. 103 in example 1 except that a drying condition (an air ejection velocity, a variation of air ejection velocity in the coated film width direction of an organic compound layer) after an organic compound layer coating solution having been coated was changed as shown in table 2, being cooled down to room temperature, the resulting substrate was wound on a core to make a roll form, whereby sample Nos. 201-214 were prepared. Herein, an air ejection velocity was measured by hot air anemometer Model 6113, manufactured by Kanomax Co., Ltd., and a wind velocity distribution in the width direction was calculated by the following equation.

Wind velocity distribution=(maximum wind velocity−minimum wind velocity)/mean wind velocity×100

Evaluation

With respect to prepared sample Nos. 201-214, the state of a coated surface was visually evaluated and the evaluation result based on the following evaluation ranks is shown in table 2.

A: No unevenness and no mottle, of the coated layer surface, are observed.

B: Slight unevenness and mottle, of the coated layer surface, which is not problematic in practical use, are partly observed.

C: Unevenness and mottle, of the coated layer surface, are observed all over the surface.

TABLE 2

| Sample No. | Air ejection velocity (m/s) | Variation of air ejection velocity in width direction of organic compound layer (%) | State of coated surface |
|---|---|---|---|
| 201 | 0.08 | 4.0 | B |
| 202 | 0.1 | 4.0 | A |
| 203 | 0.5 | 4.0 | A |
| 204 | 1.0 | 4.0 | A |
| 205 | 5.0 | 4.0 | A |
| 206 | 6.0 | 4.0 | B |
| 207 | 1.0 | 0.08 | B |
| 208 | 1.0 | 0.1 | A |
| 209 | 1.0 | 0.5 | A |
| 210 | 1.0 | 1.0 | A |
| 211 | 1.0 | 5.0 | A |
| 212 | 1.0 | 8.0 | A |
| 213 | 1.0 | 10.0 | A |
| 214 | 1.0 | 11.0 | B |

The effectiveness of the present invention has been proved.

Example 3

An organic compound layer was formed in a similar manner to preparation of sample No. 103 in example 1 except that a surface tension of an organic compound layer coating solution was changed as shown in table 3, being cooled down to room temperature, the resulting substrate was wound on a core to make a roll form, whereby sample Nos. 301-307 were prepared. Herein, a surface tension was measured by surface tension meter CBVP-A3, manufactured by Kyowa Interface Science Co., Ltd.

Evaluation

With respect to prepared sample Nos. 301-307, the state of a coated surface was visually evaluated and the evaluation result based on the following evaluation ranks is shown in table 2.

A: No unevenness and no mottle, of the coated layer surface, are observed.

B: Slight unevenness and mottle, of the coated layer surface, which is not problematic in practical use, are partly observed.

C: Unevenness and mottle, of the coated layer surface, are observed all over the surface.

TABLE 3

| Sample No. | Surface tension ($\times 10^{-3}$ N/m) | State of coated surface |
|---|---|---|
| 301 | 13 | B |
| 302 | 15 | A |
| 303 | 25 | A |
| 304 | 35 | A |
| 305 | 45 | A |

TABLE 3-continued

| Sample No. | Surface tension ($\times 10^{-3}$ N/m) | State of coated surface |
|---|---|---|
| 306 | 55 | A |
| 307 | 57 | B |

The effectiveness of the present invention has been proved.

Example 4

An organic compound layer was formed in a similar manner to preparation of sample No. 103 in example 1 except that a heat treatment condition, after an organic compound layer coating solution having been coated and dried, was changed as shown in table 3, being cooled down to room temperature, the resulting substrate was wound on a core to make a roll form, whereby sample Nos. 401-308 were prepared.

Evaluation

With respect to sample Nos. 401-408, a lifetime of an organic compound layer (emission layer) was evaluated, and the result is shown in table 4. Herein, as for a lifetime of an organic compound layer (emission layer), time required to decrease luminance when the sample was driven at a constant current of 2.5 mA/cm$^2$ to the half was employed as an index and evaluation was carried out based on the relative value when a lifetime of a sample without a heat treatment was set to 100. The heat treatment temperature is shown as a temperature based on a glass transition temperature (225° C.) of an organic compound layer (emission layer).

TABLE 4

| Sample No. | Heat treatment temperature | Lifetime (relative value) |
|---|---|---|
| 401 | No heat treatment | 100 |
| 402 | −32 | 115 |
| 403 | −30 | 140 |
| 404 | −20 | 146 |
| 405 | ±0 | 150 |
| 406 | +20 | 148 |
| 407 | +30 | 143 |
| 408 | +32 | 123 |

The effectiveness of the present invention was proved.

Example 5

An organic compound layer (emission layer) was formed by processing under identical conditions with preparation of sample No. 103 in example 1, except that an environmental condition, from coating of a hole transport layer coating solution and an organic compound layer (emission layer) coating solution until forming a hole transport layer and an organic compound layer (emission layer), was changed as shown in table 5, being cooled down to room temperature, the resulting substrate was wound on a core to make a roll form, whereby sample Nos. 501-507 were prepared. Herein, cleanliness is shown by a value measured based on JISB 9920, and cleanliness was changed by varying a filter. Further, since the coating temperature of a hole transport layer coating solution and an organic compound layer (emission layer) coating solution was 25° C., processes other than a dryer and a heat treatment apparatus was carried out at a temperature of 25° C. under an atmospheric condition.

Evaluation

With respect to prepared sample Nos. 501-507, a non-emission defect was visually confirmed and the evaluation result based on the following ranking is shown in table 5.

Confirmation Method of Non-emission Defect

After the prepared sample having been stored in a thermostat of 80° C. for 1 week, presence of a non-emitting point was visually confirmed when the sample was driven at a constant current of 2.5 mA/cm.

Evaluation Rank of Non-emission Defect

A: No non-emission defect is recognized.

B: A slight non-emission defect, which is not problematic in practical use, is recognized.

C: A few non-emission defects, which are problematic in practical use, are observed.

TABLE 5

| Sample No. | Dew point temperature (° C.) | Cleanliness class | Non-emission defect |
|---|---|---|---|
| 501 | −15 | 5 | B |
| 502 | −20 | 5 | A |
| 503 | −50 | 5 | A |
| 504 | −30 | 6 | B |
| 505 | −30 | 5 | A |
| 506 | −30 | 4 | A |
| 507 | −30 | 3 | A |

It is estimated that sample No. 501 caused a non-emission defect due to moisture content in a sample and sample No. 504 caused a non-emission defect due to adhered foreign matters. The effectiveness of the present invention has been proved.

Example 6

Sample Nos. 601-606 were prepared in identical conditions with sample No. 103 prepared in example 1 except the storing condition was changed as shown in table 6. Herein, the storing term was set to 5 days.

Evaluation

With respect to sample Nos. 601-606, the evaluation item same as that of example 4 was measured by the same measuring method and the result is shown in table 6. Herein, a life time (relative value) is a relative value against a life time when a storing condition is $10^{-5}$ Pa.

TABLE 6

| Sample No. | Storing condition (Pa) | Life time (relative value) |
|---|---|---|
| 601 | $10^{2}$ | 82 |
| 602 | $10^{1}$ | 90 |
| 603 | $10^{-1}$ | 95 |
| 604 | $10^{-3}$ | 98 |
| 605 | $10^{-5}$ | 100 |
| 606 | $10^{-6}$ | 101 |

Sample No. 606 showed an excellent lifetime (a relative value), however, the equipment becomes excessively large to keep a high vacuum considering the obtained effects, resulting in anxiety of maintenance and control of equipment and cost up. The effectiveness of the present invention has been proved.

What is claimed is:

1. A method of forming an organic compound layer of an organic EL element, the organic EL element comprising a flexible band substrate having thereon an anode layer comprising a first electrode, the organic compound layer, a cathode layer comprising a second electrode and a sealing layer or a sealing film, in that order, comprising the steps of:

forming an anode layer comprising at least a first electrode on a flexible band substrate to form flexible band substrate A;

winding flexible band substrate A on a core to form a roll of flexible band substrate A;

supplying the roll of flexible band substrate A to a supplying section of a manufacturing apparatus;

forming at least one organic compound layer on flexible band substrate A supplied from the supplying section using a wet coating device for applying an organic compound layer coating liquid on flexible band substrate A under an atmospheric pressure in a coating section comprised in a coating•drying section;

removing an organic solvent in the organic compound layer under an atmospheric pressure in a drying section comprised in the coating•drying section to form flexible band substrate B; and winding flexible band substrate B on a core to form a roil of flexible band substrate B in a recovery section, wherein the roll of flexible band substrate B is manufactured by a manufacturing apparatus comprising the supplying section, the coating•drying section, and the recovery section;

the coating•drying section comprises a coating section and a drying section to form a unit; and the manufacturing apparatus comprises at least one unit of the coating•drying section, wherein the organic compound layer is formed by removing the organic solvent in the organic compound layer by an air drying method in which an air ejecting rate is 0.1 to 5 m/s while a variation of the air ejecting rate in the width direction is 0.1 to 10%, in the drying section wherein the organic compound layer comprises at least a hole transport layer and an organic light emission layer.

2. The method of claim 1, wherein flexible band substrate A is subjected to a cleaning-surface modifying treatment before the organic compound layer coating liquid is applied.

3. The method of claim 2, wherein a means of the cleaning-surface modifying treatment is oxygen plasma or UV irradiation.

4. The method of claim 1, wherein flexible band substrate A is subjected to a static elimination treatment using a static eliminating means.

5. The method of claim 1, wherein a variation of a conveying speed of flexible band substrate A while the organic compound layer coating liquid is applied is 0.2 to 10% based on an average conveying speed.

6. The method of claim 1, wherein the organic compound layer coating liquid comprises at least one organic compound material and at least one organic solvent, and exhibits a surface tension of $15\times10^{-3}$ to $55\times10^{-3}$ N/m.

7. The method of claim 1, wherein the manufacturing apparatus comprises a heat treating section which follows the drying section.

8. The method of claim 7, wherein, just after the organic compound layer is formed in the drying section, the organic compound layer is subjected to a heat treatment using a back-surface heat transmission at a heat treatment temperature of −30 to +30° C. based on a glass transition temperature of the organic compound layer, while the heat treatment temperature does not exceed a decomposition temperature of the organic compound layer.

9. The method of claim 1, wherein the organic compound layer is formed in an atmosphere having a dew point of −20° C. or lower, a cleanliness class according to JIS B 9920 of class 5 or less, a temperature of 10 to 45° C. excluding the drying section and a heat treatment section, under an atmospheric pressure.

10. The method of claim 1, wherein flexible band substrate B is stored under a reduced pressure of $10^{-5}$ to 10 Pa.

11. A method of manufacturing an organic EL element comprising the steps of:

forming an anode layer comprising at least a first electrode on a flexible band substrate to form flexible band substrate A;

winding flexible band substrate A on a core to form a roll of flexible band substrate A;

supplying the roll of flexible band substrate A to a supplying section of a manufacturing apparatus;

forming at least one organic compound layer on flexible band substrate A supplied from the supplying section using a wet coating device for applying an organic compound layer coating liquid on flexible band substrate A under an atmospheric pressure in a coating section comprised in a coating•drying section;

removing an organic solvent in the organic compound layer under an atmospheric pressure to form flexible band substrate B in a drying section comprised in the coating•drying section;

winding flexible band substrate B on a core to form a roll of flexible band substrate B;

forming a cathode layer comprising a second electrode on the organic compound layer in a cathode layer forming section under a reduced pressure, using the roll of flexible band substrate B;

forming a sealing layer on the cathode layer in a sealing layer forming section under a reduced pressure to form the organic EL element; and winding the organic EL element on a core to form a roll of the organic EL element in a recovery section, wherein the organic EL element comprises the flexible band substrate having thereon the anode layer comprising the first electrode, the organic compound layer, the cathode layer comprising the second electrode and the sealing layer, in that order;

the organic EL element is manufactured using the organic EL element manufacturing apparatus comprising the supplying section, the coating•drying section in which the organic compound layer is formed on the anode layer, the cathode layer forming section in which the cathode layer comprising the second electrode is formed on the organic compound layer, the sealing layer forming section in which a sealing layer is formed on the cathode layer and the recovery section;

the coating•drying section comprises a coating section and a drying section to form a unit; and the manufacturing apparatus comprises at least one unit of the coating•drying section, wherein the organic compound layer is formed by removing the organic solvent in the organic compound layer by an air drying method in which an air ejecting rate is 0.1 to 5 m/s while a variation of the air ejecting rate in the width direction is 0.1 to 10%, in the drying section wherein the organic compound layer comprises at least a hole transport layer and an organic light emission layer.

12. A method of manufacturing an organic EL element comprising the steps of:

forming an anode layer comprising at least a first electrode on a flexible band substrate to form flexible band substrate A;

winding flexible band substrate A on a core to form a roll of flexible band substrate A;

supplying the roll of flexible band substrate A to a supplying section of a manufacturing apparatus;

forming at least one organic compound layer on flexible band substrate A supplied from the supplying section using a wet coating device for applying an organic compound layer coating liquid on flexible band substrate A under an atmospheric pressure in a coating section comprised in a coating•drying section;

removing an organic solvent in the organic compound layer under an atmospheric pressure in a drying section comprised in the coating•drying section to form flexible band substrate B;

winding flexible band substrate B on a core in a first winding section to form a roll of flexible band substrate B;

forming a cathode layer comprising a second electrode on the organic compound layer in a cathode layer forming section under a reduced pressure, using the roll of flexible band substrate B to form flexible band substrate C;

winding flexible band substrate C on a core in a second winding section to form a roll of flexible band substrate C;

adhering a sealing film on the cathode layer in a sealing film adhering section under an inert gas atmosphere to form the organic EL element; and winding the organic EL element on a core to form a roll of the organic EL element in a recovery section, wherein the organic EL element comprises the flexible band substrate having thereon the anode layer comprising the first electrode, the organic compound layer, the cathode layer comprising the second electrode and the sealing film, in that order;

the organic EL element is manufactured using the manufacturing apparatus comprising the supplying section;

the coating•drying section in which the organic compound layer is formed on the anode layer, the cathode layer forming section in which the cathode layer comprising the second electrode is formed on the organic compound layer, the sealing film adhering section in which a sealing film is adhered on the cathode layer and the recovery section;

the coating•drying section comprises a coating section and a drying section to form one unit; and the manufacturing apparatus comprises at least one unit of the coating•drying section, wherein the organic compound layer is formed by removing the organic solvent in the organic compound layer by an air drying method in which an air ejecting rate is 0.1 to 5 m/s while a variation of the air ejecting rate in the width direction is 0.1 to 10%, in the drying section wherein the organic compound layer comprises at least a hole transport layer and an organic light emission layer.

* * * * *